US012480750B2

(12) United States Patent
Chia et al.

(10) Patent No.: US 12,480,750 B2
(45) Date of Patent: Nov. 25, 2025

(54) FOAM DART HAVING A SAFETY CAP WITH POLYGONAL APERTURES

(71) Applicants: EASEBON SERVICES LIMITED, Hong Kong (CN); Francis See Chong Chia, Hong Kong (CN)

(72) Inventors: Francis See Chong Chia, Hong Kong (CN); Xubin Xia, Guangdong (CN)

(73) Assignee: Easebon Services Limited, Kwun Tong (HK)

( * ) Notice: Subject to any disclaimer, the term of this patent is extended or adjusted under 35 U.S.C. 154(b) by 68 days.

(21) Appl. No.: 18/254,256

(22) PCT Filed: Mar. 4, 2021

(86) PCT No.: PCT/SG2021/050113

§ 371 (c)(1),
(2) Date: May 24, 2023

(87) PCT Pub. No.: WO2022/124978

PCT Pub. Date: Jun. 16, 2022

(65) Prior Publication Data

US 2024/0142205 A1 May 2, 2024

(51) Int. Cl.

| | |
|---|---|
| ***A63B 65/02*** | (2006.01) |
| ***F42B 6/00*** | (2006.01) |
| ***F42B 6/08*** | (2006.01) |

(52) U.S. Cl.
CPC ..... *F42B 6/08* (2013.01); *F42B 6/003* (2013.01)

(58) Field of Classification Search
CPC ..... F42B 6/003; F42B 6/08
See application file for complete search history.

(56) References Cited

U.S. PATENT DOCUMENTS

| | | | | |
|---|---|---|---|---|
| 6,083,127 | A * | 7/2000 | O'Shea | A63H 33/18 446/213 |
| 8,968,126 | B2 * | 3/2015 | Chia | F42B 6/08 473/578 |
| 9,261,336 | B2 * | 2/2016 | Chang | B29C 48/06 |
| 9,285,194 | B2 * | 3/2016 | Chia | F42B 6/003 |
| 9,435,621 | B1 * | 9/2016 | Yeh | F42B 6/08 |
| 9,459,081 | B2 * | 10/2016 | Chia | F42B 6/003 |
| 10,030,950 | B1 * | 7/2018 | Chia | F42B 6/003 |

* cited by examiner

*Primary Examiner* — John A Ricci
(74) *Attorney, Agent, or Firm* — Amster, Rothstein & Ebenstein LLP

(57) ABSTRACT

A toy dart includes a deformable cap that safely impacts a target. The cap includes pairs of polygonal apertures formed on the outer surface of the cap which form substantially parallel hollow passages that provide spaces that allow the cap to deform upon impact with a target.

31 Claims, 28 Drawing Sheets

FOAM DART HAVING A SAFETY CAP WITH POLYGONAL APERTURES

CROSS-REFERENCE TO RELATED APPLICATIONS

This application claims the benefit of and priority to U.S. Provisional Patent Application Ser. No. 63/122,231, filed Dec. 7, 2020 and entitled FOAM DART HAVING A SAFETY CAP WITH POLYGONAL APERTURES, the contents of which are incorporated herein by reference in their entirety as if fully set forth herein.

FIELD

The present invention is generally related to an improved toy dart that includes a foam body and a safety cap having polygonal apertures.

BACKGROUND

Manufacturers have been making various types of toy darts, such as a dart having a foam body and a cap attached to one end of the dart body, that may be launched with a compatible toy dart launcher toward a person or an object. The caps of the toy darts are generally made of a material other than foam that allows the dart to be shot from the launcher at a targeted person, and propelled over an appropriate distance at a relatively quick speed. It is important to achieve the distance and/or speed objectives without injuring, or at least limiting the injury or discomfort felt by, the targeted person.

Maintaining safety has become more challenging as customers want to have improved darts that are even more accurate, travel at even faster speeds, and/or travel over even longer distances. At the same time, toy darts must also meet government-mandated safety requirements that are tightened from time to time. For example, in the United States, ASTM F 963-16, The Standard Consumer Safety Specification for Toy Safety, is currently mandated by the U.S. Consumer Product Safety Commission. This Standard specifies a Kinetic Energy Density (KED) test with a maximum of 2500 J/m$^2$ (Joules/meter square) for projectile toys. Thus, consumer demands for improvements in toy dart performance require new toy dart designs that are safe.

Traditionally, toy dart development has been primarily focused on maximizing the distance traveled by the darts. Indeed, toy dart marketing efforts often boast of the flight distance that the toy darts are capable of. Many toy dart manufacturers claim flight distances of up to 90 feet for their products. To achieve such flight distances, the center of gravity of the toy dart needs to be placed at the dart's forward tip. A continuing problem, however, with darts having such large flight distances is the potential discomfort or injury that a person can sustain upon being struck by a dart at close range. For example, if a person is struck at a distance of one foot from where the dart has been fired, the impact force can cause significant discomfort.

Toy dart manufacturers have tried to address the problem of using long-flight darts while minimizing the risk of injury to the persons using them. The conventional solution manufacturers have implemented is to provide a hollow cap which compresses on impact. This solution, however, has disadvantages. For example, the hollow cap needs to be glued to a separate base which, in turn, needs to be glued to the foam body of the dart. This results in increased manufacturing and assembly costs due to the need to separately manufacture the cap and the base, as well as the need to glue these components together and to the foam body of the dart, which prolongs the manufacturing process. Further, the gluing operations can result in manufacturing errors which can result in reduced accuracy of the toy darts when they are used. Specifically, it is possible for two or more components (i.e., the cap, base, and foam body) to be glued off-center from one another, which reduces the distance that the dart can travel and as well as the accuracy of the dart after it is launched.

Further, present toy darts using hollow caps have suboptimal compression performance. Indeed, the hollow dart caps in current use fail to dissipate a significant portion of the impact force when a person is struck by the dart, which results in pain and discomfort. Moreover, the hollow dart caps are often composed of materials that are abrasive upon impact with a person's skin.

What is needed is an improved foam dart toy, which can meet performance specifications regarding distance, speed, and accuracy while at the same time maintaining appropriate safety precautions to avoid and/or limit injuries upon impact. What is also needed is an improved foam dart toy that meets these safety and performance requirements by optimal placement of the dart's center of gravity and by optimally distributing the weight of the dart. The improved foam dart is manufactured in such a way as to minimize inaccuracy of the dart in operation and to minimize manufacturing and assembly costs.

SUMMARY

The present invention is generally related to an improved toy dart that includes a foam body and a safety cap having polygonal apertures.

In accordance with an exemplary embodiment of the present invention, a toy dart comprises an elongate dart body having a head end and a tail end, the dart body extending in a longitudinal direction; and a solid substantially cylindrical deformable dart cap, wherein the solid substantially cylindrical deformable dart cap has an outer wall having a top edge and a bottom edge, the outer wall forming a circumference of the solid substantially cylindrical deformable dart cap, a top surface adjoining the top edge of the outer wall, and a bottom surface adjoining the bottom edge of the outer wall, wherein the bottom surface is affixed to and abuts the head end of the elongate dart body, wherein the outer wall has formed thereon a plurality of polygonal aperture pairs, each polygonal aperture pair comprising a pair of apertures that are substantially the same size, shape, and orientation, wherein each polygonal aperture pair defines a first and second end of a corresponding hollow passage through the solid substantially cylindrical deformable dart cap, and wherein each of the hollow passages has a plurality of interior walls that forms a cross section of the hollow passage, each cross section having substantially the same size, shape and orientation as the polygonal aperture pair corresponding to the respective hollow passage.

In accordance with exemplary embodiments, the top surface is substantially flat.

In accordance with exemplary embodiments, the top surface is substantially curved.

In accordance with exemplary embodiments, the plurality of polygonal aperture pairs comprises a first aperture pair that defines a first and second end of a first hollow passage, a second aperture pair that defines a first and second end of a second hollow passage, a third aperture pair that defines a first and second end of a third hollow passage, and a fourth aperture pair that defines a first and second end of a fourth hollow passage, wherein the respective first ends of the second and third hollow passages are located along a first minor arc of the circumference of the solid substantially cylindrical deformable dart cap that extends between the respective first ends of the first and fourth hollow passages, and wherein the respective second ends of the second and third hollow passages are located along a second minor arc of the circumference of the solid substantially cylindrical deformable dart cap that extends between the respective second ends of the first and fourth hollow passages.

In accordance with exemplary embodiments, the first, second, third, and fourth hollow passages are substantially parallel, wherein the first end of the second passage is at a location above the first end of the third passage in the longitudinal direction, and wherein the second end of the second passage is at a location above the second end of the third passage in the longitudinal direction.

In accordance with exemplary embodiments, the cross sections of the first and fourth hollow passages are substantially diamond-shaped, and wherein the cross sections of the second and third hollow passages are substantially triangle-shaped.

In accordance with exemplary embodiments, the cross sections of the first, second, third and fourth hollow passages are substantially triangle-shaped, wherein the first hollow passage is oriented such that the apex of the triangle points in a clockwise direction around the circumference of the dart cap, wherein the second hollow passage is oriented such that the apex of the triangle points toward the bottom surface of the dart cap, wherein the third hollow passage is oriented such that the apex of the triangle points toward the top surface of the dart cap, and wherein the fourth hollow passage is oriented such that the apex of the triangle points in a counterclockwise direction around the circumference of the dart cap.

In accordance with exemplary embodiments, the plurality of polygonal aperture pairs comprises a first aperture pair that defines a first and second end of a first hollow passage, a second aperture pair that defines a first and second end of a second hollow passage, and a third aperture pair that defines a first and second end of a third hollow passage, wherein the first end of the second hollow passage is located along a minor arc of the circumference of the solid substantially cylindrical deformable dart cap that extends between the respective first ends of the first and third hollow passages, and wherein the second end of the second hollow passage is located along a minor arc of the circumference of the solid substantially cylindrical deformable dart cap that extends between the respective second ends of the first and third hollow passages.

In accordance with exemplary embodiments, the first, second, and third hollow passages are substantially parallel.

In accordance with exemplary embodiments, the cross sections of the first, second, and third hollow passages are substantially triangle-shaped.

In accordance with exemplary embodiments, the first hollow passage is oriented such that the apex of the triangle points toward the top surface of the dart cap, wherein the second hollow passage is oriented such that the apex of the triangle points toward the bottom surface of the dart cap, wherein the third hollow passage is oriented such that the apex of the triangle points toward the top surface of the dart cap.

In accordance with exemplary embodiments, the solid substantially cylindrical deformable dart cap has a top portion adjoining the top edge of the outer wall, wherein the outer wall forms first and second circumferences of the solid substantially cylindrical deformable dart cap, wherein the second circumference is between the first circumference and the top portion of the solid substantially cylindrical deformable dart cap, and wherein the second circumference is less than the first circumference.

In accordance with exemplary embodiments, the substantially cylindrical deformable dart cap comprises a material with a Shore A durometer that is within a range of 20 to 40.

In accordance with exemplary embodiments, the deformable dart cap comprises a material with a Shore A durometer of approximately 30.

In accordance with exemplary embodiments, the deformable dart cap has a Shore A durometer that is within a range of 20 to 80.

In accordance with exemplary embodiments, the deformable dart cap has a Shore A durometer that is within a range of 40 to 70.

In accordance with exemplary embodiments, the deformable dart cap has a Shore A durometer of approximately 70.

In accordance with exemplary embodiments, the elongate dart body is cylindrical.

In accordance with exemplary embodiments, the top surface of the substantially cylindrical deformable dart cap has a diameter of approximately 12.5 mm.

In accordance with exemplary embodiments, the substantially cylindrical deformable dart cap comprises thermoplastic rubber (TPR) that is injection molded.

In accordance with exemplary embodiments, the top surface of the substantially cylindrical deformable dart cap is shaped as a spherical segment, spherical frustum, or spherical dome.

In accordance with exemplary embodiments, the deformable dart cap has a unitary structure.

In accordance with exemplary embodiments, the first and fourth hollow passages are approximately equal in shape and cross sectional area.

In accordance with exemplary embodiments, the second and third hollow passages are approximately equal in cross sectional area and wherein the second and third hollow passages each has a smaller cross sectional area than each of the first and fourth hollow passages.

In accordance with exemplary embodiments, the first and third hollow passages are approximately equal in cross sectional area.

In accordance with exemplary embodiments, a toy dart comprises an elongate dart body having a head end and a tail end, the dart body extending in a longitudinal direction; and a solid cylindrical deformable dart cap, wherein the cylindrical deformable dart cap has an outer wall having a top edge and a bottom edge, the outer wall forming a circumference of the cylindrical deformable dart cap, a top surface adjoining the top edge of the outer wall, and a bottom surface adjoining the bottom edge of the outer wall, wherein the bottom surface is affixed to and abuts the head end of the elongate dart body, wherein the outer wall has formed thereon a plurality of polygonal aperture pairs, each polygonal aperture pair comprising a pair of apertures that are substantially the same size, shape, and orientation, wherein each polygonal aperture pair defines a first and second end of a corresponding hollow passage through the cylindrical deformable dart cap, wherein each of the hollow passages has a plurality of interior walls that forms a cross section of the hollow passage, each cross section having substantially the same size, shape and orientation as the pair of apertures of the polygonal aperture pair corresponding to the respective hollow passage, wherein the plurality of polygonal aperture pairs comprises a first aperture pair that defines a first and second end of a first hollow passage, a second aperture pair that defines a first and second end of a second hollow passage, a third aperture pair that defines a first and second end of a third hollow passage, and a fourth aperture pair that defines a first and second end of a fourth hollow passage, wherein the respective first ends of the second and third hollow passages are located along a first minor arc of the circumference of the cylindrical deformable dart cap that extends between the respective first ends of the first and fourth hollow passages, wherein the respective second ends of the second and third hollow passages are located along a second minor arc of the circumference of the cylindrical deformable dart cap that extends between the respective second ends of the first and fourth hollow passages, wherein the cross sections of the first and fourth hollow passages are substantially diamond-shaped, and wherein the cross sections of the second and third hollow passages are substantially triangle-shaped, wherein the second hollow passage is oriented such that the apex of the triangle shaped second hollow passage is pointed toward the bottom surface of the cylindrical deformable dart cap and the third hollow passage is oriented such that the apex of the triangle-shaped third hollow passage is pointed toward the top surface of the cylindrical deformable dart cap.

In accordance with exemplary embodiments, a toy dart comprises an elongate dart body having a head end and a tail end, the dart body extending in a longitudinal direction; and a solid cylindrical deformable dart cap, wherein the cylindrical deformable dart cap has an outer wall having a top edge and a bottom edge, the outer wall forming a circumference of the cylindrical deformable dart cap, a top surface adjoining the top edge of the outer wall, and a bottom surface adjoining the bottom edge of the outer wall, wherein the bottom surface is affixed to and abuts the head end of the elongate dart body, wherein the outer wall has formed thereon a plurality of polygonal aperture pairs, each polygonal aperture pair comprising a pair of apertures that are substantially the same size, shape, and orientation, wherein each polygonal aperture pair defines a first and second end of a corresponding hollow passage through the cylindrical deformable dart cap, wherein each of the hollow passages has a plurality of interior walls that forms a cross section of the hollow passage, each cross section having substantially the same size, shape and orientation as the pair of apertures of the polygonal aperture pair corresponding to the respective hollow passage, wherein the plurality of polygonal aperture pairs comprises a first aperture pair that defines a first and second end of a first hollow passage, a second aperture pair that defines a first and second end of a second hollow passage, a third aperture pair that defines a first and second end of a third hollow passage, and a fourth aperture pair that defines a first and second end of a fourth hollow passage, wherein the respective first ends of the second and third hollow passages are located along a first minor arc of the circumference of the cylindrical deformable dart cap that extends between the respective first ends of the first and fourth hollow passages, wherein the respective second ends of the second and third hollow passages are located along a second minor arc of the circumference of the cylindrical deformable dart cap that extends between the respective second ends of the first and fourth hollow passages, wherein the cross sections of the first, second, third and fourth hollow passages are substantially triangle-shaped, wherein the first hollow passage is oriented such that the apex of the triangle-shaped first hollow passage is pointed in a clockwise direction around the circumference of the cylindrical deformable dart cap, wherein the second hollow passage is oriented such that the apex of the triangle-shaped second hollow passage is pointed toward the bottom surface of the cylindrical deformable dart cap, wherein the third hollow passage is oriented such that the apex of the triangle-shaped third hollow passage is pointed toward the top surface of the cylindrical deformable dart cap, and wherein the fourth hollow passage is oriented such that the apex of the triangle-shaped fourth hollow passage in a counterclockwise direction around the circumference of the cylindrical deformable dart cap.

In accordance with exemplary embodiments, a toy dart comprises an elongate dart body having a head end and a tail end, the dart body extending in a longitudinal direction; and a solid cylindrical deformable dart cap, wherein the cylindrical deformable dart cap has an outer wall having a top edge and a bottom edge, the outer wall forming a circumference of the cylindrical deformable dart cap, a top surface adjoining the top edge of the outer wall, and a bottom surface adjoining the bottom edge of the outer wall, wherein the bottom surface is affixed to and abuts the head end of the elongate dart body, wherein the outer wall has formed thereon a plurality of polygonal aperture pairs, each polygonal aperture pair comprising a pair of apertures that are substantially the same size, shape, and orientation, wherein each polygonal aperture pair defines a first and second end of a corresponding hollow passage through the cylindrical deformable dart cap, wherein each of the hollow passages has a plurality of interior walls that forms a cross section of the hollow passage, each cross section having substantially the same size, shape and orientation as the pair of apertures of the polygonal aperture pair corresponding to the respective hollow passage, wherein the plurality of polygonal aperture pairs comprises a first aperture pair that defines a first and second end of a first hollow passage, a second aperture pair that defines a first and second end of a second hollow passage, and a third aperture pair that defines a first and second end of a third hollow passage, wherein the first end of the second hollow passage is located along a minor arc of the circumference of the solid cylindrical deformable dart cap that extends between the respective first ends of the first and third hollow passages, and wherein the second end of the second hollow passage is located along a minor arc of the circumference of the solid cylindrical deformable dart cap that extends between the respective second ends of the first and third hollow passages, wherein the cross sections of the first, second, and third hollow passages are substantially triangle-shaped, wherein the first hollow passage is oriented such that the apex of the triangle-shaped first hollow passage is pointed toward the top surface of the cylindrical deformable dart cap, wherein the second hollow passage is oriented such that the apex of the triangle-shaped second hollow passage is pointed toward the bottom surface of the cylindrical deformable dart cap, and wherein the third hollow passage is oriented such that the apex of the triangle-shaped third hollow passage is pointed toward the top surface of the cylindrical deformable dart cap.

In accordance with exemplary embodiments, a toy dart comprises an elongate dart body having a head end and a tail end, the dart body extending in a longitudinal direction; and a solid cylindrical deformable dart cap, wherein the cylindrical deformable dart cap has an outer wall having a top edge and a bottom edge, the outer wall forming a circumference of the cylindrical deformable dart cap, a top surface adjoining the top edge of the outer wall, and a bottom surface adjoining the bottom edge of the outer wall, wherein the bottom surface is affixed to and abuts the head end of the elongate dart body, wherein the outer wall has formed thereon a plurality of polygonal aperture pairs, each polygonal aperture pair comprising a pair of apertures that are substantially the same size, shape, and orientation, wherein each polygonal aperture pair defines a first and second end of a corresponding hollow passage through the cylindrical deformable dart cap, wherein each of the hollow passages has a plurality of interior walls that forms a cross section of the hollow passage, each cross section having substantially the same size, shape and orientation as the pair of apertures of the polygonal aperture pair corresponding to the respective hollow passage, wherein the plurality of polygonal aperture pairs comprises a first aperture pair that defines a first and second end of a first hollow passage, a second aperture pair that defines a first and second end of a second hollow passage, and a third aperture pair that defines a first and second end of a third hollow passage, wherein the first end of the second hollow passage is located along a minor arc of the circumference of the solid cylindrical deformable dart cap that extends between the respective first ends of the first and third hollow passages, and wherein the second end of the second hollow passage is located along a minor arc of the circumference of the solid cylindrical deformable dart cap that extends between the respective second ends of the first and third hollow passages, wherein the cross sections of the first, second, and third hollow passages are substantially triangle-shaped, wherein the first hollow passage is oriented such that the apex of the triangle-shaped first hollow passage is pointed toward the bottom surface of the cylindrical deformable dart cap, wherein the second hollow passage is oriented such that the apex of the triangle-shaped second hollow passage is pointed toward the top surface of the cylindrical deformable dart cap, and wherein the third hollow passage is oriented such that the apex of the triangle-shaped third hollow passage is pointed toward the bottom surface of the cylindrical deformable dart cap.

In accordance with exemplary embodiments, a toy dart comprises an elongate dart body having a head end and a tail end, the dart body extending in a longitudinal direction; and a solid cylindrical deformable dart cap, wherein the cylindrical deformable dart cap has an outer wall having a top edge and a bottom edge, the outer wall forming a circumference of the cylindrical deformable dart cap, a top surface adjoining the top edge of the outer wall, and a bottom surface adjoining the bottom edge of the outer wall, wherein the bottom surface is affixed to and abuts the head end of the elongate dart body, wherein the outer wall has formed thereon a plurality of polygonal aperture pairs, each polygonal aperture pair comprising a pair of apertures that are substantially the same size, shape, and orientation, wherein each polygonal aperture pair defines a first and second end of a corresponding hollow passage through the cylindrical deformable dart cap, wherein each of the hollow passages has a plurality of interior walls that forms a cross section of the hollow passage, each cross section having substantially the same size, shape and orientation as the polygonal aperture pair corresponding to the respective hollow passage, wherein the plurality of polygonal aperture pairs comprises a first aperture pair that defines a first and second end of a first hollow passage, a second aperture pair that defines a first and second end of a second hollow passage, and a third aperture pair that defines a first and second end of a third hollow passage, wherein the first end of the second hollow passage is located along a minor arc of the circumference of the solid cylindrical deformable dart cap that extends between the respective first ends of the first and third hollow passages, wherein the second end of the second hollow passage is located along a minor arc of the circumference of the solid cylindrical deformable dart cap that extends between the respective second ends of the first and third hollow passages, wherein the cross sections of the first, second, and third hollow passages are substantially triangle-shaped, wherein the aperture corresponding to the first end of the first hollow passage is formed as a first right triangle oriented such that the hypotenuse of the first right triangle faces the aperture corresponding to the first end of the second hollow passage, wherein the aperture corresponding to the first end of the second hollow passage is formed as a second triangle oriented such that the apex of the second triangle is pointed toward the bottom surface of the cylindrical deformable dart cap, wherein the aperture corresponding to the first end of the third hollow passage is formed as a third right triangle oriented such that the hypotenuse of the third right third triangle faces the aperture corresponding to the first end of the second hollow passage, wherein the aperture corresponding to the second end of the first hollow passage is formed as a fourth right triangle oriented such that the hypotenuse of the fourth right triangle faces the aperture corresponding to the second end of the second hollow passage, wherein the aperture corresponding to the second end of the second hollow passage is formed as a fifth triangle oriented such that the apex of the fifth triangle is pointed toward the bottom surface of the cylindrical deformable dart cap, wherein the aperture corresponding to the second end of the third hollow passage is formed as a sixth right triangle oriented such that the hypotenuse of the sixth right third triangle faces the aperture corresponding to the second end of the second hollow passage, wherein the first hollow passage has an outer surface that is a vertical post, and wherein the third hollow passage has an outer surface that is a vertical post.

BRIEF DESCRIPTION OF THE DRAWINGS

Exemplary embodiments of the present invention will be described with references to the accompanying figures, wherein.

DETAILED DESCRIPTION

The present invention is generally related to an improved toy dart, such as a foam dart that may be used in a compatible toy dart launcher. The toy dart has an elongate dart body and a cap that is affixed to the dart body, where the cap has a configuration that enables the dart to accurately target a person or object and travel a relatively long distance, while impacting the target in a safe manner.

Figure 1A:
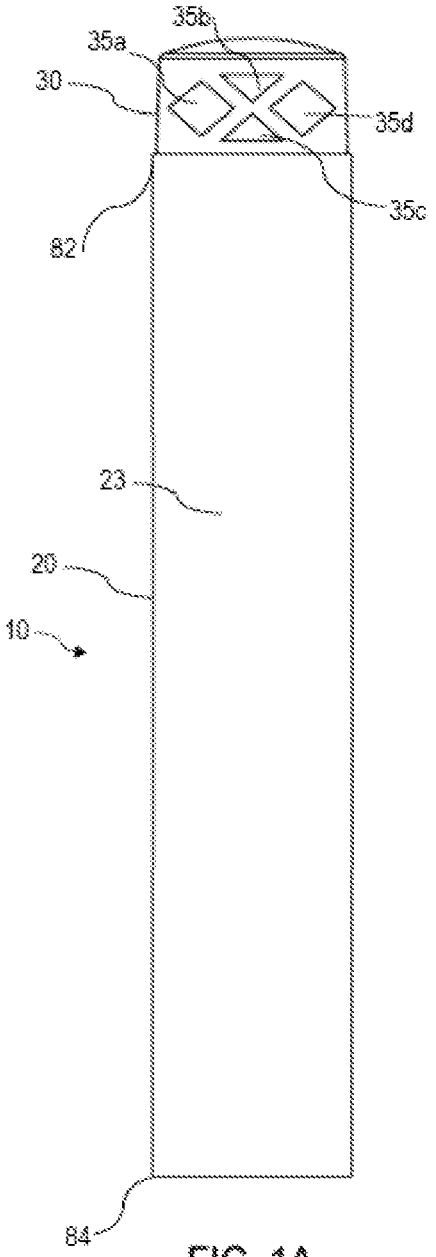
FIG. 1A is a plan view of a dart with a cap where the dart is displayed in a first angular orientation in accordance with a first exemplary embodiment of the present invention.

Referring to FIG. 1A, a dart 10 in accordance with exemplary embodiments of the present invention has an elongate profile configured for aerodynamic flight toward a target, such as toward a person or other object. In embodiments, dart 10 may have a length of about, e.g., within a range of 55 mm to 75 mm, such as 59 mm, 65 mm, 67 mm, 70 mm, 73 mm, or 74 mm, to name a few. In embodiments, dart 10 may have an outer cross-sectional diameter at its widest point of, for example, 12.5 mm, 13 mm, 14 mm, or 15 mm, to name a few. Further, in embodiments, dart 10 may have other lengths, widths, and/or diameters.

Figure 3A:
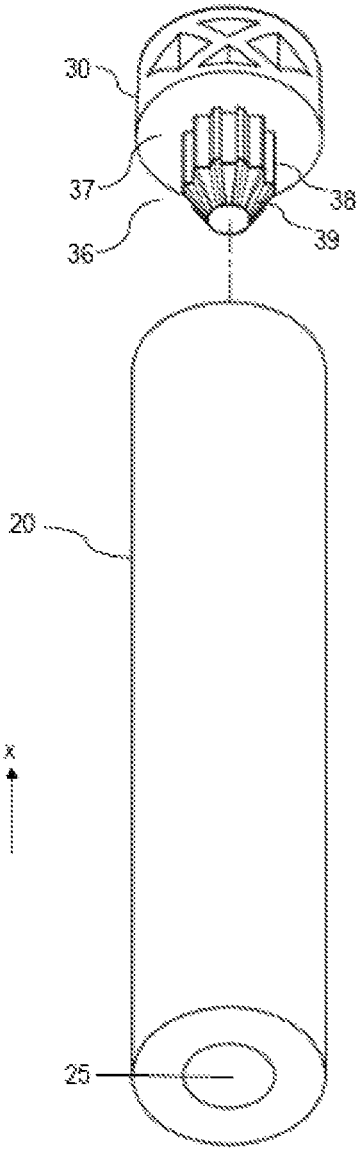
FIG. 3A is an exploded view of the dart, including a dart body and dart cap, shown from a first perspective with the dart cap in the orientation of FIG. 1A in accordance with a first exemplary embodiment of the present invention.

Dart 10 includes an elongate dart body 20 that extends from a first end (a head end) 82 to a second end (a tail end) 84 of the elongate dart body 20 in a first, longitudinal direction x (see FIG. 3A). Dart 10 further includes a dart cap 30 that is affixed to the head end of the dart body 20.

Elongate dart body 20 includes a lightweight material, such as a foam, that is suitable for use in a toy projectile and has an interior bore 25. Referring to FIGS. 1A and 3A, dart body 20 is illustrated as having, for example, an outer surface 23 that is substantially cylindrical in shape and interior bore 25 (or interior core) that is also cylindrical in shape with a circular cross-section. In embodiments, interior bore 25 may have a diameter that at its widest point is, for example, 5 mm, 5.5 mm, or 6 mm, to name a few. However, in embodiments, interior bore 25 may have a different diameter. Alternatively, elongate dart body 20 and/or interior bore 25 may have a different cross-sectional shape, such as an oval, pyramidal, diamond, heptagonal, or octagonal shape. Interior bore 25 may extend entirely or at least partially through dart body 20. In embodiments, interior bore 25 of dart body 20 may be lined with materials that provide dart body 20 with certain mechanical properties, e.g., rigidity or resiliency. In exemplary embodiments, the dart body 20 may be formed of one or more pieces.

Dart cap 30 is affixed to the head end of the dart body 20. In exemplary embodiments, dart cap 30 is cylindrical in shape and is solid. Dart cap 30 has a plurality of polygonal apertures 35*a*, 35*b*, 35*c*, 35*d*, 35*e*, 35*f*, 35*g*, 35*h* which are formed on its outer surface. As shown in FIG. 1A, a first pair of polygonal apertures 35*a* and 35*d* are diamond shaped and a second pair of polygonal apertures 35*b* and 35*c* are triangular in shape. In embodiments, polygonal apertures 35*b* and 35*c* are formed along a minor arc around the circumference of dart cap 30, where the minor arc extends between polygonal apertures 35*a* and 35*d*.

Figure 1B:
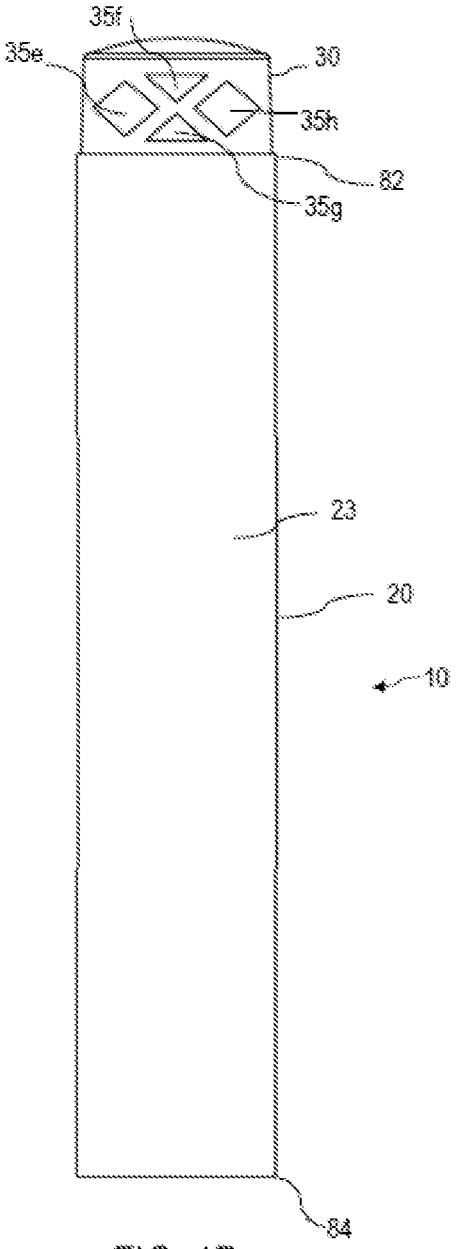
FIG. 1B is a plan view of the dart rotated 180 degrees from the angular orientation shown in FIG. 1A in accordance with a first exemplary embodiment of the present invention.

According to exemplary embodiments, each of polygonal apertures 35*a*, 35*b*, 35*c*, and 35*d* defines a first end of a hollow passage that passes through dart cap 30. FIG. 1B depicts a view of dart 10, which shows the dart rotated 180 degrees. In this view, an additional four polygonal apertures are shown: polygonal apertures 35*e*, 35*f*, 35*g*, and 35*h*. Like the polygonal apertures depicted in FIG. 1A, each of polygonal apertures 35*e*, 35*f*, 35*g*, and 35*h* are formed on the outer surface of dart cap 30. Each of polygonal apertures 35*e*, 35*f*, 35*g*, and 35*h* define a second end of the hollow passages for which the polygonal apertures 35*a*-35*d* define respective first ends. Thus, according to embodiments, polygonal aperture 35*e* is a second end of the hollow passage that has a first end defined by polygonal aperture 35*d*, polygonal aperture 35*h* is a second end of the hollow passage that has its first end defined by polygonal aperture 35*a*, polygonal aperture 35*f* is a second end of the hollow passage defined by polygonal aperture 35*b*, and polygonal aperture 35*g* is a second end of the hollow passage that has its first end defined by polygonal aperture 35*c*.

As shown in FIGS. 1A and 1B, each of the hollow passages defined by their respective polygonal aperture pairs have a cross sectional area that is substantially the same in size, shape and orientation as the polygonal aperture at each end. Thus, for example, the hollow passage that corresponds to polygonal apertures 35*d* and 35*e* is substantially diamond shape. Likewise, the hollow passage that corresponds to polygonal apertures 35*b* and 35*f* is substantially triangular in shape. Other shapes for the polygonal apertures are contemplated and within the scope of the present invention. Further, as shown in FIGS. 1A and 1B, each of the triangular polygonal apertures 35*b* and 35*f* are inverted triangles, while polygonal apertures 35*c* and 35*g* are upright triangles. That is, the hollow passage defined by apertures 35*c* and 35*g* are triangular having an apex at the top of the triangular passage. By contrast, the hollow passage defined by apertures 35*b* and 35*f* are triangular having an apex at the bottom of the triangular passage. Other orientations for these apertures, as well as the diamond shaped apertures, are possible and are within the scope of the present invention. In exemplary embodiments, the apertures may include multiple layers of apertures, with the size, shape and/or orientation of the apertures being the same or different from layer to layer.

In exemplary embodiments, the hollow passages defined by the aperture pairs extend through the interior of solid dart cap 30 and are substantially parallel to one another. Further, in embodiments, the diamond shaped hollow passages defined by aperture pair 35*a* and 35*h* and aperture pair 35*d* and 35*e* have a larger cross sectional area than the hollow passages defined by aperture pair 35*b* and 35 *f* and aperture pair 35*c* and 35*g*. The hollow passages provide spaces that allow dart cap 30 to deform upon impact.

In exemplary embodiments, dart cap 30 may have a unitary structure formed by, for example, injection molding. In alternative exemplary embodiments, dart cap 30 may be formed of one or more pieces.

As shown in FIGS. 1A and 1B, in the illustrated embodiment, dart cap 30 has a rounded, or dome shaped, top portion. In exemplary embodiments, the top portion of dart cap 30 may be substantially flat. In exemplary embodiments, the top of dart cap 30 may be substantially flat, may be tapered, may be curved, such as in the shape of a spherical segment, spherical frustum, or spherical dome, or may have some other shape. Providing a taper or curved top that adds material to the top of dart 10 may enhance the aerodynamic profile of the dart cap to improve the speed and accuracy of the dart and lengthen the distance over which dart 10 can travel.

Figure 2A:
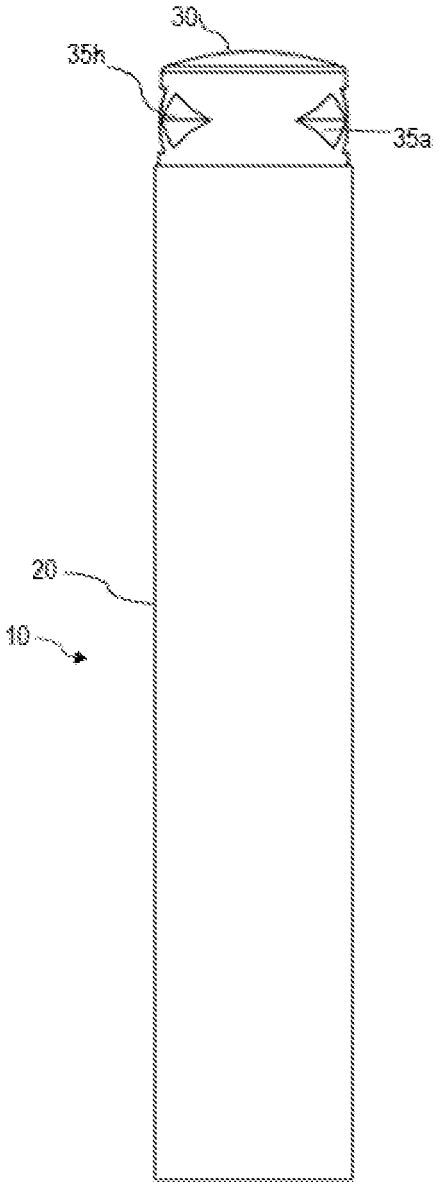
FIG. 2A is a plan view of the dart rotated 90 degrees clockwise from the angular orientation shown in FIG. 1A in accordance with a first exemplary embodiment of the present invention.
Figure 2B:
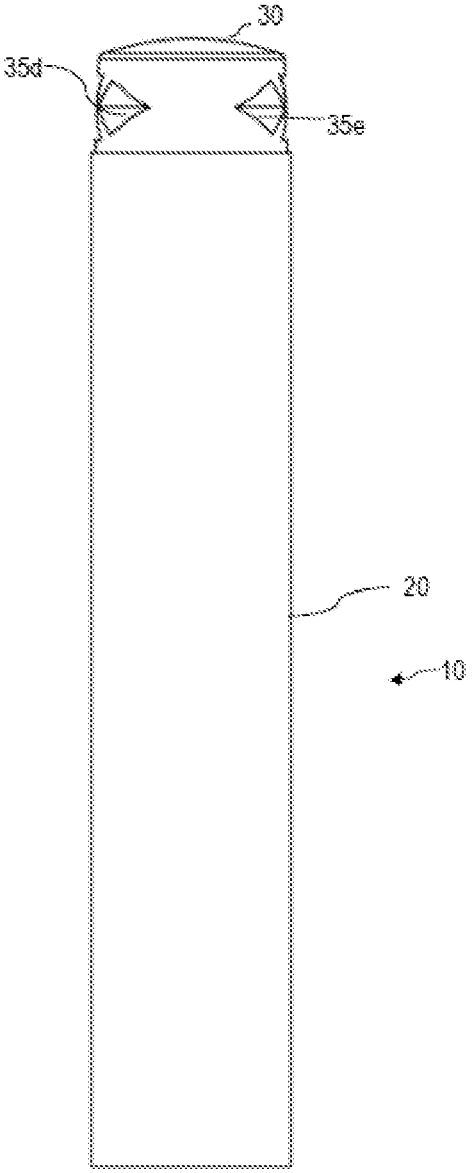
FIG. 2B is a plan view of the dart rotated 90 degrees counterclockwise from the angular orientation shown in FIG. 1A in accordance with a first exemplary embodiment of the present invention.

FIGS. 2A and 2B further illustrate the exemplary embodiment of the present invention, with FIG. 2A being a plan view of the dart rotated 90 degrees clockwise from the angular orientation shown in FIG. 1A and with FIG. 2B being a plan view of the dart rotated 90 degrees counterclockwise from the angular orientation shown in FIG. 1A. FIG. 2A shows the two ends of the hollow passage formed by apertures 35*h* and 35*a* as passing laterally across the side of dart cap 30. FIG. 2B shows the two ends of the hollow passage formed by apertures 35*d* and 35*e*, similarly passing laterally across the side of dart cap 30. In this view, the hollow passages formed by apertures 35*b*, 35*c*, 35*f*, and 35*g* are not visible. Further, in contrast with the view of dart 10 from the angular orientations of FIGS. 1A and 1B, a viewer cannot see through dart cap 30 when viewing from the angular orientations shown in FIGS. 2A and 2B.

Figure 3B:
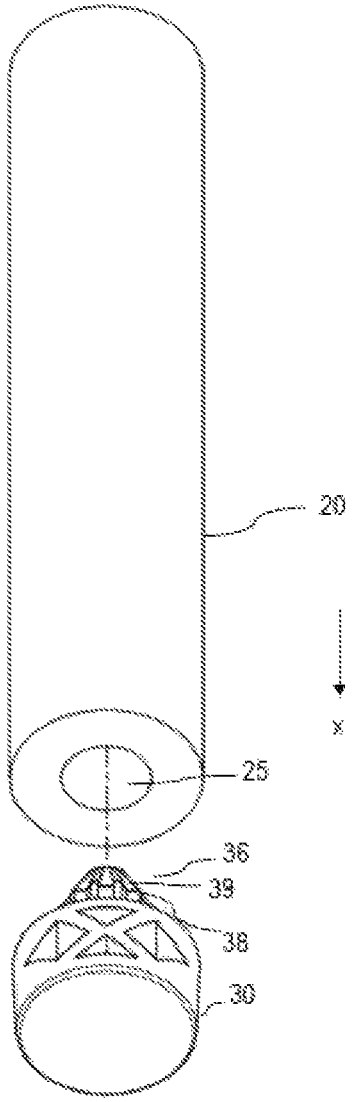
FIG. 3B is an exploded view of the dart, including a dart body and dart cap, shown from a second perspective with the dart cap in the orientation of FIG. 1A in accordance with a first exemplary embodiment of the present invention.

The exploded views of FIGS. 3A and 3B highlight additional features of dart cap 30. In particular, FIG. 3A illustrates a dart cap 30 that includes a stem 36 at the bottom of cap 30 that is insertable into interior bore 25 of dart body 20 to affix cap 30 to dart body 20. Stem 36 may be formed integrally with dart cap 30 so as to form a unitary structure or may be attached thereto, and may be formed of one or more pieces.

In exemplary embodiments, dart cap 30 is affixed to dart body 20 with an adhesive, such as a glue, that may be applied around stem 36, inside the interior bore 25, and/or to a bottom surface 37 of dart cap 20. To provide additional surface area on dart cap 30 to more strongly affix cap 30 to dart body 20, stem 36 may include one or more grooves, such as grooves 38 and 39 that can accommodate additional adhesive. In embodiments, dart cap 30 may be affixed to dart body 20 in a manner other than with an adhesive.

Although stem 36 is illustrated with a particular design, it should be understood that the stem 36 for dart cap 30 is not limited to the illustrated design, and may be shaped and/or sized differently. For example, there may not be any grooves and stem 36 may have an enlarged plug attached to the bottom of stem 36 to help hold stem 36 within interior bore 25.

Dart cap 30 is made to be heavier than the relatively lightweight configuration of dart body 20, such as by providing the various structures (e.g., exterior posts, interior walls, a thicker material top (e.g., dome shape)) and by choosing a particular composition of material, so as to position the center of gravity of dart 10 toward the head of the dart 10. This improves the accuracy and aerodynamics of dart 10.

Figure 4:
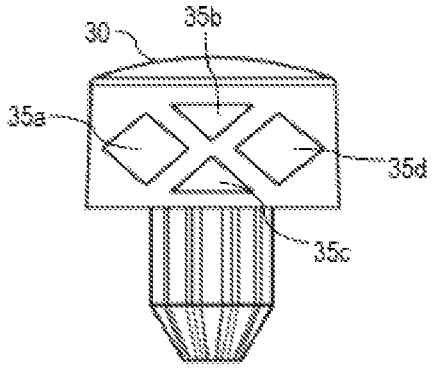
FIG. 4 is an enlarged plan view of the dart cap without the dart body shown in the orientation of FIG. 1A in accordance with a first exemplary embodiment of the present invention.
Figure 5:
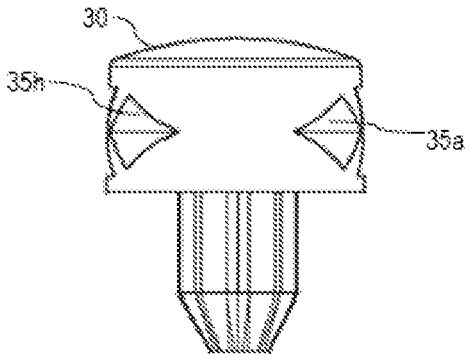
FIG. 5 is an enlarged plan view of the dart cap without the dart body shown in the orientation of FIG. 1B in accordance with a first exemplary embodiment of the present invention.

FIG. 4 shows an enlarged view of dart cap 30 with a first angular orientation as shown in FIG. 1A. FIG. 5 shows an enlarged view of dart cap 30 with a second angular orientation as shown in FIG. 2A. As shown in FIG. 4, the hollow passages defined by polygonal apertures 35*a*, 35*b*, 35*c*, and 35*d* allow a viewer to see through dart cap 30. In FIG. 5, however, which is a view of dart cap 30 in FIG. 4, but rotated by 90 degrees, the viewer cannot see completely through any of the hollow passages of dart cap 30. Rather, the viewer is able to see polygonal apertures 35*h* and 35*a*, which define two ends of a single hollow passage that passes through the solid interior of dart cap 30.

It should be understood that, as with the dimensions of elongate dart body 20, the dimensions of dart cap 30 and structures thereof may vary. For example, in embodiments, the height of dart cap 30 excluding the height of stem 36 may be in a range of 6-9 mm, stem 36 has a length, such as a length of at least 5 mm, and a diameter that is sized to fit and securely hold dart cap 30 within interior bore 25, and grooves 38, 39 within stem 36 may be in a range of 0.5 to 0.7 mm. However, in embodiments, dart cap 30 and structures thereof may have different dimensions, such as different lengths, heights, widths, and/or diameters.

In exemplary embodiments, dart cap 30 is made of a soft, flexible and/or resilient material, that can be injection molded. For example, dart cap 30 may be made of injection molded thermoplastic rubber (TPR). In embodiments, cap 30 could alternatively be made of, for example, polyvinyl chloride (PVC), styrene-butadiene-styrene (SBS), or ethylene-vinyl acetate (EVA), to name a few.

In exemplary embodiments, dart cap 30 has a Shore durometer measurement that is sufficiently rigid to maintain the integrity of the cap but relatively soft to lessen the impact on a target.

In exemplary embodiments, the molding material may have a Shore A durometer that is within a range of 15 to 80. In embodiments, the molding material may have a Shore A durometer that is within a range of 20 to 80, or a range of 20 to 70, or a range of 40 to 70, or a range of 20 to 60, or a range of 30 to 60, or a range of 20 to 40, to name a few. In embodiments, the molding material may have a Shore A durometer that is approximately 30, or approximately 40, or approximately 50, or approximately 70, to name a few. In embodiments, the molding material may have a Shore A durometer that is at least 20, or at least 30, or at least 40, to name a few. In embodiments, the molding material may have a Shore A durometer that is no more than 80, or no more than 70, or no more than 50, to name a few. In this context, approximate should be understood to be equal to the given measurement or a minor deviation from the given measurement.

In exemplary embodiments, cap 30 may have a Shore A durometer that is within a range of 15 to 80, or a range of 20 to 80, or a range of 20 to 70, or a range of 40 to 70, or a range of 20 to 60, or a range of 30 to 60, or a range of 20 to 40, to name a few. In embodiments, cap 30 may have a Shore A durometer that is approximately 30, or approximately 40, or approximately 50 or approximately 70, to name a few. In embodiments, cap 30 may have a Shore A durometer that is at least 20, or at least 30, or at least 40, to name a few. In embodiments, cap 30 may have a Shore A durometer that is no more than 80, or no more than 70 or no more than 50, to name a few. In this context, approximate should be understood to be equal to the given measurement or a minor deviation from the given measurement.

In exemplary embodiments, dart cap 30 may be measured along a different Shore durometer scale, such as Shore D, for example.

Figures 6, 7, 8:
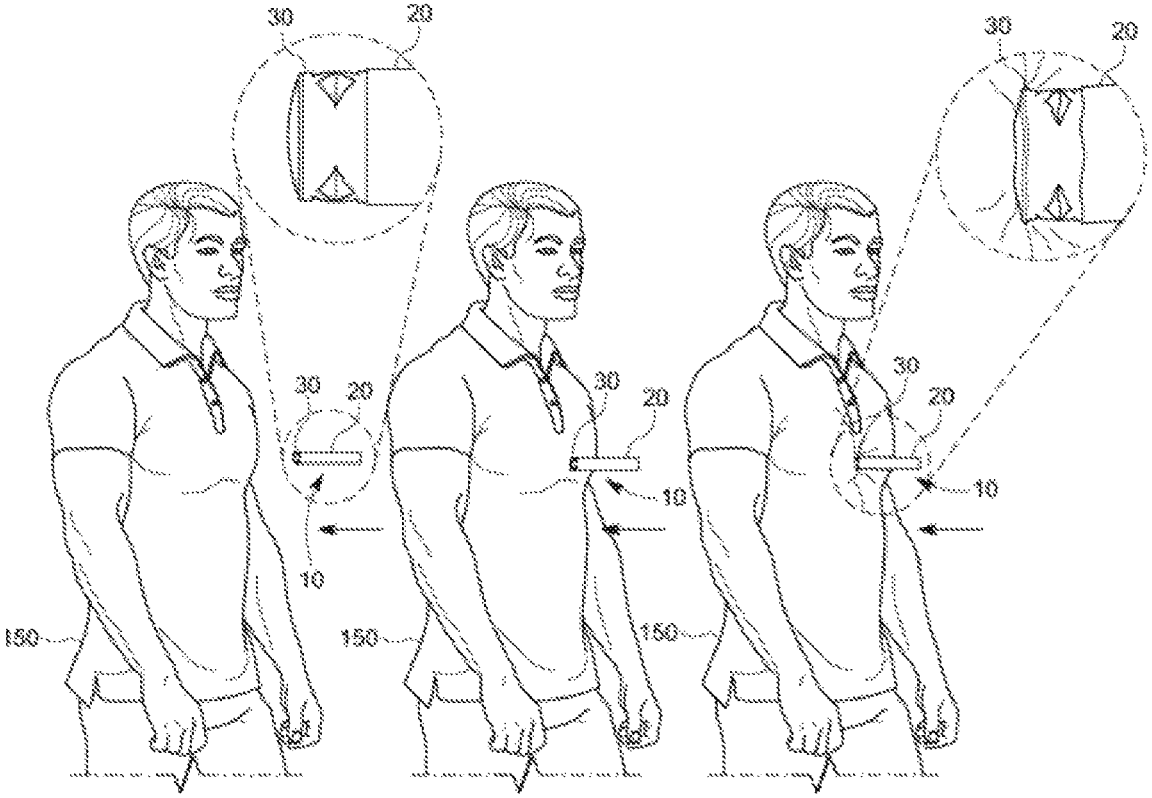
FIG. 6 shows the toy dart in accordance with a first exemplary embodiment of the invention on an incoming path toward a targeted person.
FIG. 7 shows the toy dart of FIG. 6 on initial impact on the person.
FIG. 8 shows an example of how the cap of the toy dart of FIG. 6 may deform upon impact.

FIGS. 6-8 illustrate an exemplary launch of dart 10 toward a person from a compatible toy dart launcher (not shown). The compatible toy dart launcher may launch dart 10 by forcing air or some other material, such as another gas or liquid, through the bottom of interior bore 25 at the tail end of elongate dart body 20, as shown in FIG. 3A. The forced air or other material impinges upon the bottom of stem 36 and causes the launch of the dart 10 toward a target. As an alternative to forced air or other material, dart 10 may be launched using motorized flywheels. As shown in FIG. 6, dart 10 has been launched and comes into proximity with a person 150. At FIG. 7, dart 10 impacts upon and makes contact with the person's shirt. At FIG. 8, dart 10 presses into person 150, with dart cap 30 deforming so as to safely soften the impact on the person and at least limit injuries that may be caused by the impact. As can be seen in the enlarged view within FIG. 8, the top portion of dart cap 30 deforms more than the bottom portion of dart cap 30 upon the initial impact of dart 10, with the hollow passage defined by aperture pair 35*b* and 35*f* deforming more than the hollow passage defined by aperture pair 35*c* and 35*g*. This is because the former hollow passages have four interior walls, whereas the latter hollow passages have three interior walls. After impacting the person, dart 10 bounces off and dart cap 30 may resiliently substantially return to its original shape, such as for relaunching. Also, as shown, the lightweight material, such as foam, of dart body 20 may also deform to a certain extent upon impact. It is desirable that the upper portion of dart cap 30 remain more rigid than the lower portion of dart cap 30 so that dart 10 does not wobble or deform much during flight, which would affect the accuracy of dart 10 in hitting its intended target.

Figure 9A:
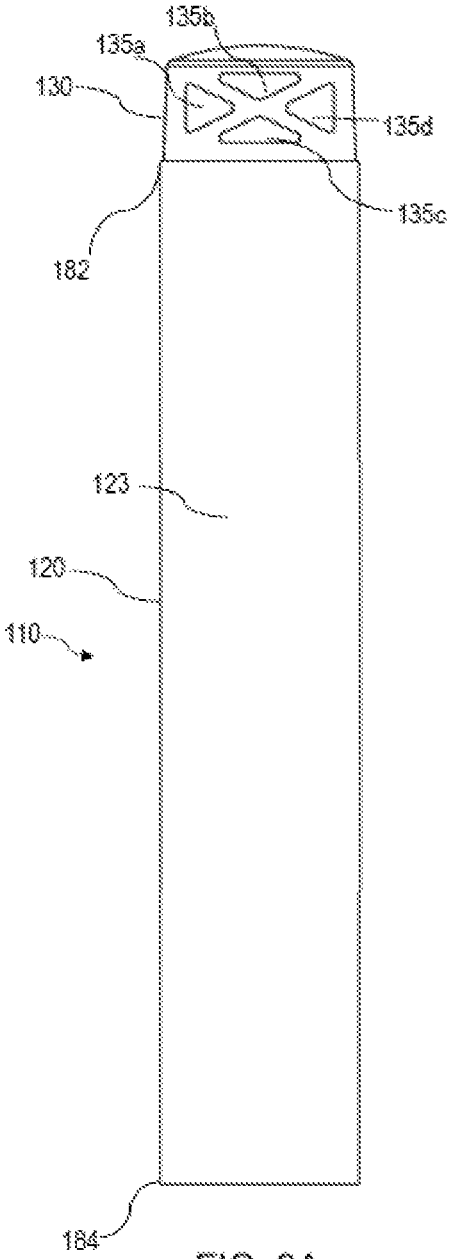
FIG. 9A is a plan view of a dart with a cap where the dart is displayed in a first angular orientation in accordance with a second exemplary embodiment of the present invention.

Referring to FIG. 9A, a dart 110 in accordance with exemplary embodiments of the present invention has an elongate profile configured for aerodynamic flight toward a target, such as toward a person or other object. In embodiments, dart 110 may have a length of about, e.g., within a range of 55 mm to 75 mm, such as 59 mm, 65 mm, 67 mm, 70 mm, 73 mm, or 74 mm, to name a few. In embodiments, dart 110 may have an outer cross-sectional diameter at its widest point of, for example, 12.5 mm, 13 mm, 14 mm, or 15 mm, to name a few. Further, in embodiments, dart 110 may have other lengths, widths, and/or diameters.

Figure 11A:
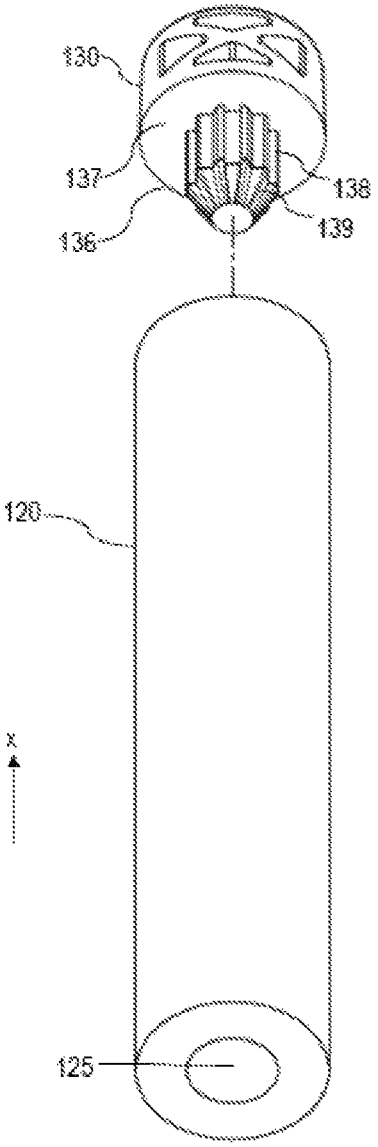
FIG. 11A is an exploded view of the dart, including a dart body and dart cap, shown from a first perspective with the dart cap in the orientation of FIG. 9A in accordance with a second exemplary embodiment of the present invention.

Dart 110 includes an elongate dart body 120 that extends from a first end (a head end) 182 to a second end (a tail end) 184 of the elongate dart body 120 in a first, longitudinal direction x (see FIG. 11A). Dart 110 further includes a dart cap 130 that is affixed to the head end of the dart body 120.

Elongate dart body 120 includes a lightweight material, such as a foam, that is suitable for use in a toy projectile and has an interior bore 125. Referring to FIGS. 9A and 11A, dart body 120 is illustrated as having, for example, an outer surface 123 that is substantially cylindrical in shape and interior bore 125 (or interior core) that is also cylindrical in shape with a circular cross-section. In embodiments, interior bore 125 may have a diameter that at its widest point is, for example, 5 mm, 5.5 mm, or 6 mm, to name a few. However, in embodiments, interior bore 25 may have a different diameter. Alternatively, elongate dart body 120 and/or interior bore 125 may have a different cross-sectional shape, such as an oval, pyramidal, diamond, heptagonal, or octagonal shape. Interior bore 125 may extend entirely or at least partially through dart body 120. In embodiments, interior bore 125 of dart body 120 may be lined with materials that provide dart body 120 with certain mechanical properties, e.g., rigidity or resiliency. In exemplary embodiments, the dart body 120 may be formed of one or more pieces.

Dart cap 130 is affixed to the head end of the dart body 120. In exemplary embodiments, dart cap 130 is cylindrical in shape and is solid. Dart cap 130 has a plurality of polygonal apertures 135*a*, 135*b*, 135*c*, 135*d*, 135*e*, 135*f*, 135*g*, 135*h* which are formed on its outer surface. As shown in FIG. 9A, the polygonal apertures 135*a*, 135*b*, 135*c*, and 135*d* are triangular in shape. In embodiments, polygonal apertures 135*b* and 135*c* are formed along minor arcs around the circumference of dart cap 130, where the minor arcs extend between polygonal apertures 135*a* and 135*d*.

Figure 9B:
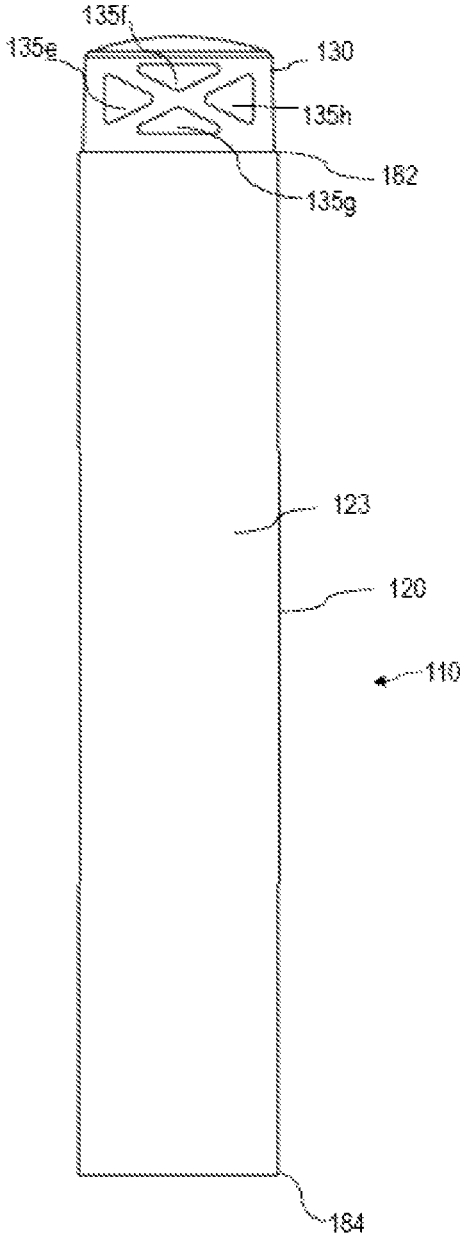
FIG. 9B is a plan view of the dart rotated 180 degrees from the angular orientation shown in FIG. 9A in accordance with a second exemplary embodiment of the present invention.

According to exemplary embodiments, each of polygonal apertures 135*a*, 135*b*, 135*c*, and 135*d* defines a first end of a hollow passage that passes through dart cap 130. FIG. 9B depicts a view of dart 110, which shows the dart rotated 180 degrees. In this view, an additional four polygonal apertures are shown: polygonal apertures 135*e*, 135*f*, 135*g*, and 135*h*. Like the polygonal apertures depicted in FIG. 9A, each of polygonal apertures 135*e*, 135*f*, 135*g*, and 135*h* are formed on the outer surface of dart cap 130. Each of polygonal apertures 135*e*, 135*f*, 135*g*, and 135*h* define a second end of the hollow passages for which the polygonal apertures 135*a*-135*d* define respective first ends. Thus, according to embodiments, polygonal aperture 135*e* is a second end of the hollow passage that has a first end defined by polygonal aperture 135*d*, polygonal aperture 135*h* is a second end of the hollow passage that has its first end defined by polygonal aperture 135*a*, polygonal aperture 135*f* is a second end of the hollow passage defined by polygonal aperture 135*b*, and polygonal aperture 135*g* is a second end of the hollow passage that has its first end defined by polygonal aperture 135*c*.

As shown in FIGS. 9A and 9B, each of the hollow passages defined by their respective polygonal aperture pairs have a cross sectional area that is substantially the same in size, shape and orientation as the polygonal aperture at each end. Thus, for example, the hollow passage that corresponds to polygonal apertures 135*d* and 135*e* is substantially triangular in shape. Likewise, the hollow passage that corresponds to the other polygonal aperture pairs (135*b* and 135*f*, 135*a* and 135*h*, and 135*c* and 135*g*) are substantially triangular in shape. Other shapes for the polygonal apertures are contemplated and within the scope of the present invention. Further, as shown in FIGS. 9A and 9B, each of the triangular polygonal apertures 135*b* and 135*f* are inverted triangles, while polygonal apertures 135*c* and 135*g* are upright triangles. That is, the hollow passage of defined by apertures 135*c* and 135*g* are triangular having an apex at the top of the triangular passage, which is pointed at the top surface of dart cap 130. By contrast, the hollow passage defined by apertures 135*b* and 135*f* are triangular having an apex at the bottom of the triangular passage, which is pointed at the bottom surface of dart cap 130. Polygonal apertures 135*a* and 135*e* are triangles that point in a clockwise direction around the circumference of dart cap 130. Polygonal apertures 135*d* and 135*h*, on the other hand, are triangles that point in a counterclockwise direction around the circumference of dart cap 130. Other orientations for these apertures are possible and are within the scope of the present invention. In exemplary embodiments, the apertures may include multiple layers of apertures, with the size, shape and/or orientation of the apertures being the same or different from layer to layer.

In embodiments, the hollow passages defined by the aperture pairs extend through the interior of solid dart cap 130 and are substantially parallel to one another. Further, in embodiments, the triangle shaped hollow passages defined by aperture pair 135*a* and 135*h* and aperture pair 135*d* and 135*e* have a larger cross sectional area than the hollow passages defined by aperture pair 135*b* and 135 *f* and aperture 135*c* and 135*g*. The hollow passages provide spaces that allow dart cap 30 to deform upon impact.

In exemplary embodiments, dart cap 130 may have a unitary structure and may be formed by, for example, injection molding. In alternative exemplary embodiments, dart cap 130 may be formed of one or more pieces.

As shown in FIGS. 9A and 9B, in the illustrated embodiment, dart cap 130 has a rounded, or dome shaped, top portion. In embodiments, the top portion of dart cap 130 may be substantially flat. In embodiments, the top of dart cap 130 may also be tapered, curved, such as in the shape of a spherical segment, spherical frustum, or spherical dome, or may have some other shape. Providing a taper or curved top that adds material to the top of dart 110 may enhance the aerodynamic profile of the dart cap to improve the speed and accuracy of the dart and lengthen the distance over which dart 110 can travel.

Figure 10A:
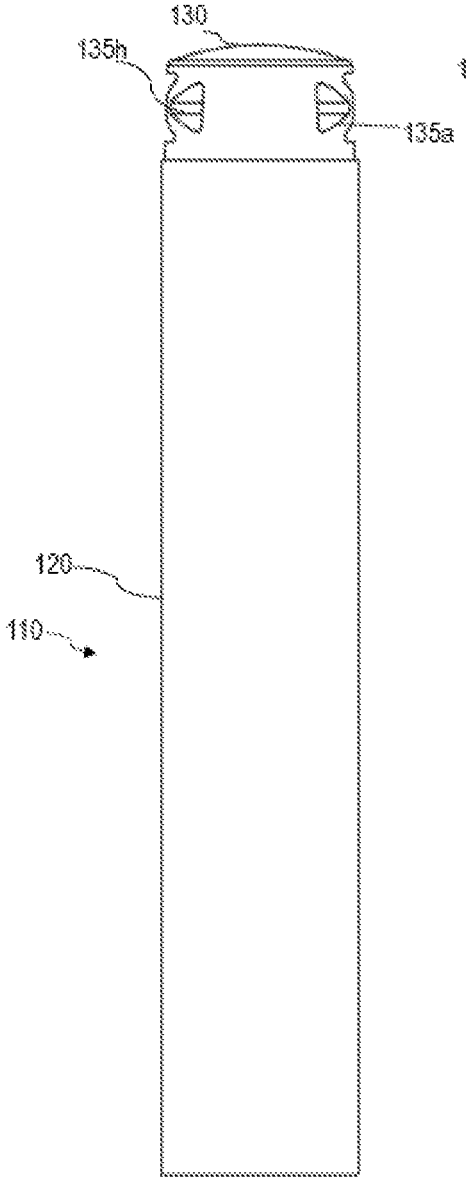
FIG. 10A is a plan view of the dart rotated 90 degrees clockwise from the angular orientation shown in FIG. 9A in accordance with a second exemplary embodiment of the present invention.
Figure 10B:
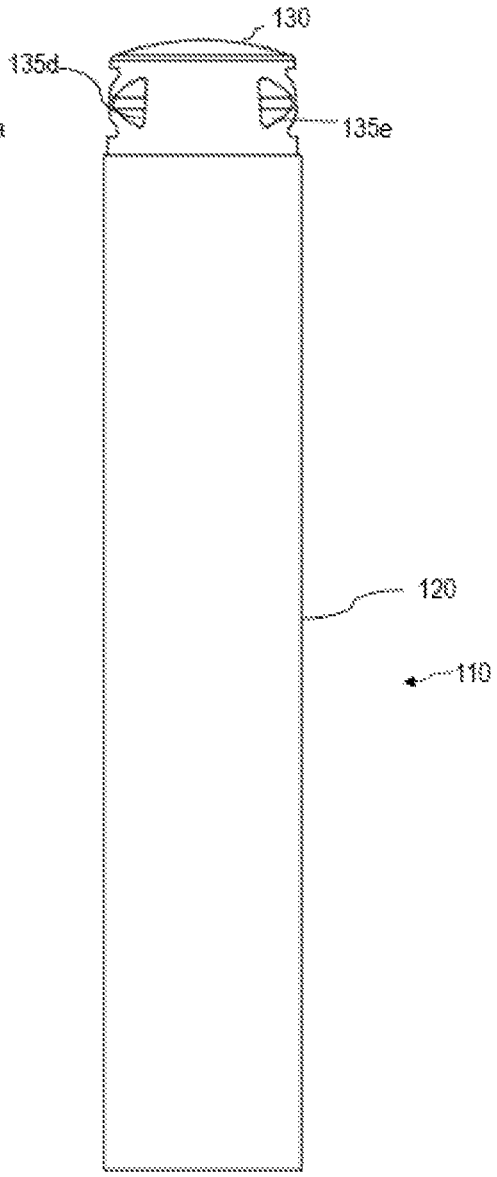
FIG. 10B is a plan view of the dart rotated 90 degrees counterclockwise from the angular orientation shown in FIG. 9A in accordance with a second exemplary embodiment of the present invention.

FIGS. 10A and 10B further illustrate the exemplary embodiment of the present invention, with FIG. 10A being a plan view of the dart rotated 90 degrees clockwise from the angular orientation shown in FIG. 9A and with FIG. 10B being a plan view of the dart rotated 90 degrees counterclockwise from the angular orientation shown in FIG. 9A. FIG. 10A shows the two ends of the hollow passage formed by apertures 135*h* and 135*a* as passing laterally across the side of dart cap 130. FIG. 10B shows the two ends of the hollow passage formed by apertures 135*d* and 135*e*, similarly passing laterally across the side of dart cap 130. In this view, the hollow passages formed by apertures 135*b*, 135*c*, 135*f*, and 135*g* are not visible. Further, in contrast with the view of dart 110 from the angular orientations of FIGS. 9A and 9B, a viewer cannot see through dart cap 130 when viewing from the angular orientations shown in FIGS. 10A and 10B.

Figure 11B:
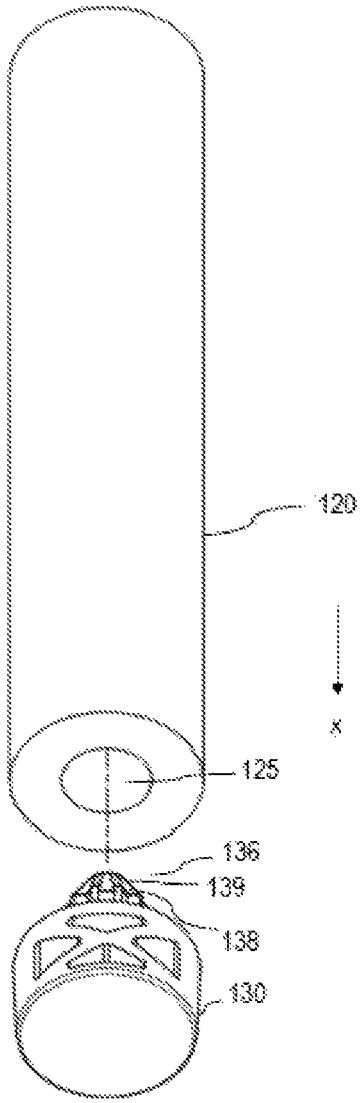
FIG. 11B is an exploded view of the dart, including a dart body and dart cap, shown from a second perspective with the dart cap in the orientation of FIG. 9A in accordance with a second exemplary embodiment of the present invention.

The exploded views of FIGS. 11A and 11B highlight additional features of dart cap 130. In particular, FIG. 11A illustrates a dart cap 130 that includes a stem 136 at the bottom of cap 130 that is insertable into interior bore 125 of dart body 120 to affix cap 130 to dart body 120. Stem 136 may be formed integrally with dart cap 130 or may be attached thereto, and may be formed of one or more pieces.

In embodiments, dart cap 130 is affixed to dart body 120 with an adhesive, such as a glue, that may be applied around stem 136, inside the interior bore 125, and/or to a bottom surface 137 of dart cap 130. To provide additional surface area on dart cap 130 to more strongly affix cap 130 to dart body 120, stem 136 may include one or more grooves, such as grooves 138 and 139 that can accommodate additional adhesive. In embodiments, dart cap 130 may be affixed to dart body 120 in a manner other than with an adhesive.

Although stem 136 is illustrated with a particular design, it should be understood that the stem 136 for dart cap 130 is not limited to the illustrated design, and may be shaped and/or sized differently. For example, there may not be any grooves and stem 136 may have an enlarged plug attached to the bottom of stem 136 to help hold stem 136 within interior bore 125.

Dart cap 130 is made to be heavier than the relatively lightweight configuration of dart body 120, such as by providing the various structures (e.g., exterior posts, interior walls, a thicker material top (e.g., dome shape)) and by choosing a particular composition of material, so as to position the center of gravity of dart 110 toward the head of the dart 110. This improves the accuracy and aerodynamics of dart 110.

Figure 12:
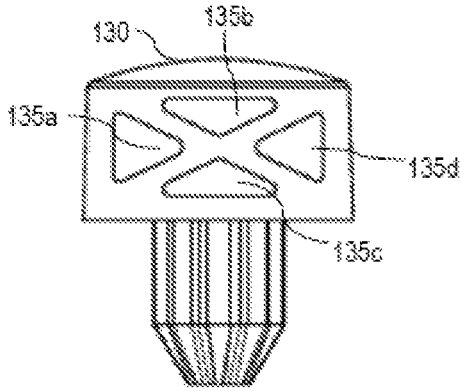
FIG. 12 is an enlarged plan view of the dart cap without the dart body shown in the orientation of FIG. 9A in accordance with a second exemplary embodiment of the present invention.
Figure 13:
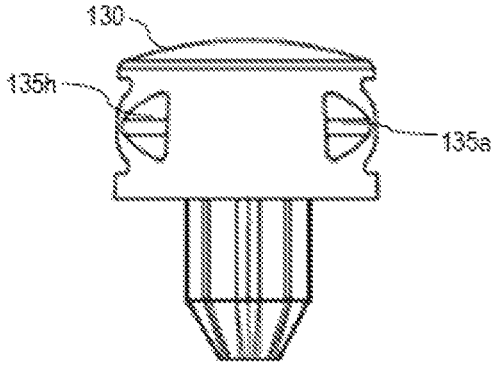
FIG. 13 is an enlarged plan view of the dart cap without the dart body shown in the orientation of FIG. 9B in accordance with a second exemplary embodiment of the present invention.

FIG. 12 shows an enlarged view of dart cap 130 with a first angular orientation as shown in FIG. 9A. FIG. 13 shows an enlarged view of dart cap 130 with a second angular orientation as shown in FIG. 10A. As shown in FIG. 12, the hollow passages defined by polygonal apertures 135*a*, 135*b*, 135*c*, and 135*d* allow a viewer to see through dart cap 130. In FIG. 13, however, which is a view of dart cap 130 in FIG. 12, but rotated by 90 degrees, the viewer cannot see completely through any of the hollow passages of dart cap 130. Rather, the viewer is able to see polygonal apertures 135*h* and 135*a*, which define two ends of a single hollow passage that passes through the solid interior of dart cap 130.

It should be understood that, as with the dimensions of elongate dart body 120, the dimensions of dart cap 130 and structures thereof may vary. For example, in embodiments, the height of dart cap 130 excluding the height of stem 136 may be in a range of 6-9 mm, stem 136 has a length, such as a length of at least 5 mm, and a diameter that is sized to fit and securely hold dart cap 130 within interior bore 125, and grooves 138, 139 within stem 136 may be in a range of 0.5 to 0.7 mm. However, in embodiments, dart cap 130 and structures thereof may have different dimensions, such as different lengths, heights, widths, and/or diameters.

In embodiments, dart cap 130 is made of a soft, flexible and/or resilient material, that can be injection molded. For example, dart cap 130 may be made of injection molded thermoplastic rubber (TPR). In embodiments, cap 130 could alternatively be made of, for example, polyvinyl chloride (PVC), styrene-butadiene-styrene (SBS), or ethylene-vinyl acetate (EVA), to name a few.

In embodiments, dart cap 130 has a Shore durometer measurement that is sufficiently rigid to maintain the integrity of the cap but relatively soft to lessen the impact on a target.

In embodiments, the molding material may have a Shore A durometer that is within a range of 15 to 80. In embodiments, the molding material may have a Shore A durometer that is within a range of 20 to 80, or a range of 20 to 70, or a range of 40 to 70, or a range of 20 to 60, or a range of 30 to 60, or a range of 20 to 40, to name a few. In embodiments, the molding material may have a Shore A durometer that is approximately 30, or approximately 40, or approximately 50, or approximately 70, to name a few. In embodiments, the molding material may have a Shore A durometer that is at least 20, or at least 30, or at least 40, to name a few. In embodiments, the molding material may have a Shore A durometer that is no more than 80, or no more than 70, or no more than 50, to name a few. In this context, approximate should be understood to be equal to the given measurement or a minor deviation from the given measurement.

In embodiments, cap 130 may have a Shore A durometer that is within a range of 15 to 80, or a range of 20 to 80, or a range of 20 to 70, or a range of 40 to 70, or a range of 20 to 60, or a range of 30 to 60, or a range of 20 to 40, to name a few. In embodiments, cap 130 may have a Shore A durometer that is approximately 30, or approximately 40, or approximately 50 or approximately 70, to name a few. In embodiments, cap 130 may have a Shore A durometer that is at least 20, or at least 30, or at least 40, to name a few. In embodiments, cap 130 may have a Shore A durometer that is no more than 80, or no more than 70 or no more than 50, to name a few. In this context, approximate should be understood to be equal to the given measurement or a minor deviation from the given measurement.

In embodiments, dart cap 130 may be measured along a different Shore durometer scale, such as Shore D, for example.

Figures 14, 15, 16:
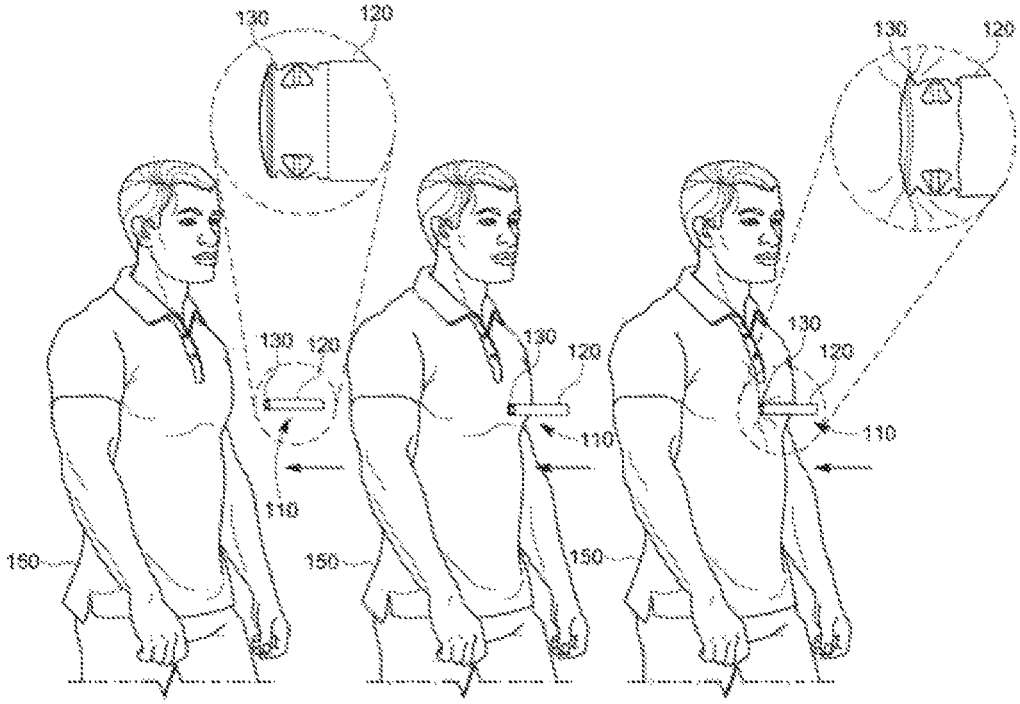
FIG. 14 shows the toy dart in accordance with a second embodiment of the invention on an incoming path toward a targeted person.
FIG. 15 shows the toy dart of FIG. 14 on initial impact on the person.
FIG. 16 shows an example of how the cap of the toy dart of FIG. 14 may deform upon impact.

FIGS. 14-16 illustrate an exemplary launch of dart 110 toward a person from a compatible toy dart launcher (not shown). The compatible toy dart launcher may launch dart 110 by forcing air or some other material, such as another gas or liquid, through the bottom of interior bore 125 at the tail end of elongate dart body 120, as shown in FIG. 11A. The forced air or other material impinges upon the bottom of stem 136 and causes the launch of the dart 110 toward a target. As an alternative to forced air or other material, dart 110 may be launched using motorized flywheels. As shown in FIG. 14, dart 110 has been launched and comes into proximity with a person 150. At FIG. 15, dart 110 impacts upon and makes contact with the person's shirt. At FIG. 16, dart 110 presses into person 150, with dart cap 130 deforming so as to safely soften the impact on the person and at least limit injuries that may be caused by the impact. As can be seen in the enlarged view within FIG. 16, the top portion of dart cap 130 deforms more than the bottom portion of dart cap 130 upon the initial impact of dart 110, with the hollow passage defined by aperture pair 135*b* and 135*f* deforming more than the hollow passage defined by aperture pair 135*c* and 135*g*. After impacting the person, dart 110 bounces off and dart cap 130 may resiliently substantially return to its original shape, such as for relaunching. Also, as shown, the lightweight material, such as foam, of dart body 120 may also deform to a certain extent upon impact. It is desirable that the upper portion of dart cap 130 remain more rigid than the lower portion of dart cap 130 so that dart 110 does not wobble or deform much during flight, which would affect the accuracy of dart 110 in hitting its intended target.

Figure 17A:
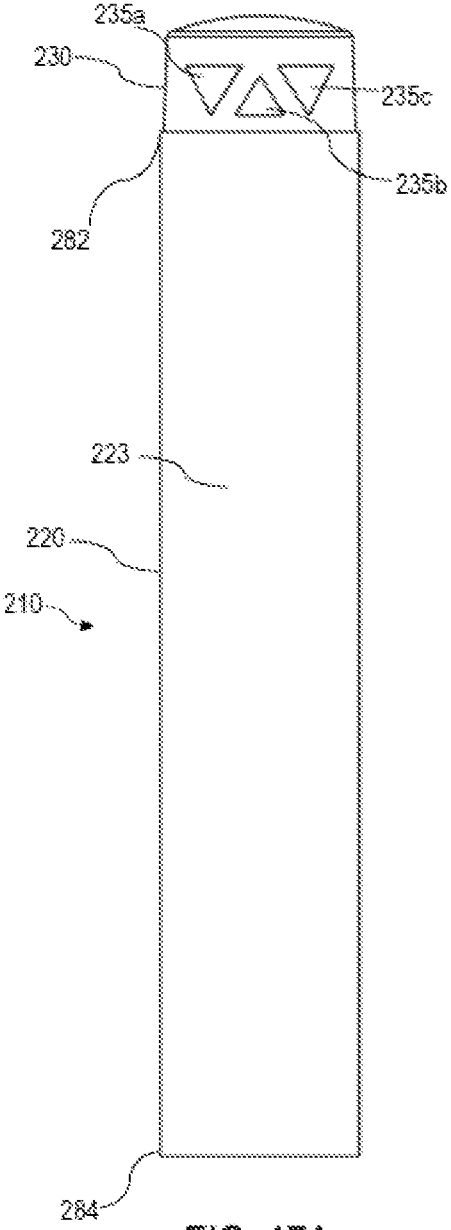
FIG. 17A is a plan view of a dart with a cap where the dart is displayed in a first angular orientation in accordance with a third exemplary embodiment of the present invention.

Referring to FIG. 17A, a dart 210 in accordance with exemplary embodiments of the present invention has an elongate profile configured for aerodynamic flight toward a target, such as toward a person or other object. In embodiments, dart 210 may have a length of about, e.g., within a range of 55 mm and 75 mm, such as 59 mm, 65 mm, 67 mm, 70 mm, 73 mm, or 74 mm, to name a few. In embodiments, dart 210 may have an outer cross-sectional diameter at its widest point of, for example, 12.5 mm, 13 mm, 14 mm, or 15 mm, to name a few. Further, in embodiments, dart 210 may have other lengths, widths, and/or diameters.

Figure 19A:
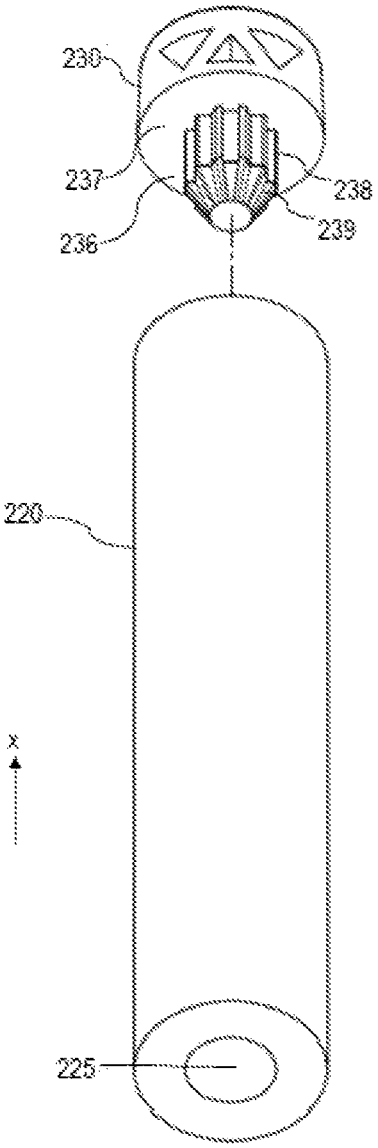
FIG. 19A is an exploded view of the dart, including a dart body and dart cap, shown from a first perspective with the dart cap in the orientation of FIG. 17A in accordance with a third exemplary embodiment of the present invention.

Dart 210 includes an elongate dart body 220 that extends from a first end (a head end) 282 to a second end (a tail end) 284 of the elongate dart body 220 in a first, longitudinal direction x (see FIG. 19A). Dart 210 further includes a dart cap 230 that is affixed to the head end of the dart body 220.

Elongate dart body 220 includes a lightweight material, such as a foam, that is suitable for use in a toy projectile and has an interior bore 225. Referring to FIGS. 17A and 19A, dart body 220 is illustrated as having, for example, an outer surface 223 that is substantially cylindrical in shape and interior bore 225 (or interior core) that is also cylindrical in shape with a circular cross-section. In embodiments, interior bore 225 may have a diameter that at its widest point is, for example, 5 mm, 5.5 mm, or 6 mm, to name a few. However, in embodiments, interior bore 225 may have a different diameter. Alternatively, elongate dart body 220 and/or interior bore 225 may have a different cross-sectional shape, such as an oval, pyramidal, diamond, heptagonal, or octagonal shape. Interior bore 225 may extend entirely or at least partially through dart body 220. In embodiments, interior bore 225 of dart body 220 may be lined with materials that provide dart body 220 with certain mechanical properties, e.g., rigidity or resiliency. In exemplary embodiments, the dart body 220 may be formed of one or more pieces.

Dart cap 230 is affixed to the head end of the dart body 220. In exemplary embodiments, dart cap 230 is cylindrical in shape and is solid. Dart cap 230 has a plurality of polygonal apertures 235*a*, 235*b*, 235*c*, 235*d*, 235*e*, 235*f* which are formed on its outer surface. As shown in FIG. 17A, the polygonal apertures 235*a*, 235*b*, and 235*c* are triangular in shape. In embodiments, polygonal aperture 235*b* is formed along a minor arc around the circumference of dart cap 230, where the minor arc extends between polygonal apertures 235*a* and 235*c*.

Figure 17B:
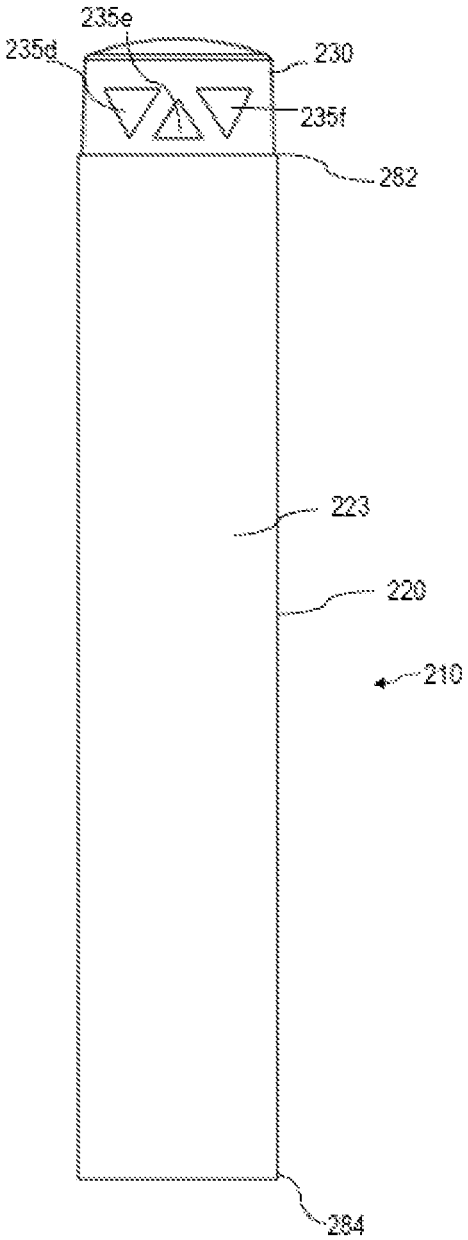
FIG. 17B is a plan view of the dart rotated 180 degrees from the angular orientation shown in FIG. 14A in accordance with a third exemplary embodiment of the present invention.

According to exemplary embodiments, each of polygonal apertures 235*a*, 235*b*, and 235*c* defines a first end of a hollow passage that passes through dart cap 230. FIG. 17B depicts a view of dart 210, which shows the dart rotated 180 degrees. In this view, an additional three polygonal apertures are shown: polygonal apertures 235*d*, 235*e*, and 235*f* Like the polygonal apertures depicted in FIG. 17A, each of polygonal apertures 235*d*, 235*e*, and 235*f* are formed on the outer surface of dart cap 230. Each of polygonal apertures 235*d*, 235*e*, and 235*f* define a second end of the hollow passages for which the polygonal apertures 235*a*-235*c* define respective first ends. Thus, according to embodiments, polygonal aperture 235*d* is a second end of the hollow passage that has a first end defined by polygonal aperture 235*c*, polygonal aperture 235*e* is a second end of the hollow passage that has its first end defined by polygonal aperture 235*b*, and polygonal aperture 235*f* is a second end of the hollow passage defined by polygonal aperture 235*a*.

As shown in FIGS. 17A and 17B, each of the hollow passages defined by their respective polygonal aperture pairs have a cross sectional area that is substantially the same in size, shape and orientation as the polygonal aperture at each end. Thus, for example, the hollow passage that corresponds to polygonal apertures 235*c* and 235*d* is substantially triangular in shape. Likewise, the hollow passage that corresponds to the other polygonal aperture pairs (235*a* and 235*f* and 235*b* and 235*e*) are substantially triangular in shape. Other shapes for the polygonal apertures are contemplated and within the scope of the present invention. Further, as shown in FIGS. 17A and 17B, each of the triangular polygonal apertures 235*b* and 235*e* are upright triangles, while polygonal apertures 235*a*, 235*c*, 235*d*, and 235*f* are inverted triangles. That is, the hollow passage of defined by apertures 235*b* and 235*e* are triangular having an apex at the top of the triangular passage, which is pointed at the top surface of dart cap 230. By contrast, the hollow passage defined by apertures 235*a*, 235*c*, 235*d*, and 235*f* are triangular having an apex at the bottom of the triangular passage, which is pointed at the bottom surface of dart cap 230. Other orientations for these apertures are possible and are within the scope of the present invention. In exemplary embodiments, the apertures may include multiple layers of apertures, with the size, shape and/or orientation of the apertures being the same or different from layer to layer.

In embodiments, the hollow passages defined by the aperture pairs extend through the interior of solid dart cap 230 and are substantially parallel to one another. Further, in embodiments, the triangle shaped hollow passages defined by aperture pair 235*a* and 235*f* and aperture pair 235*c* and 235*d* have a larger cross sectional area than the hollow passage defined by aperture pair 235*b* and 235*e*. The hollow passages provide spaces that allow dart cap 230 to deform upon impact.

In exemplary embodiments, dart cap 230 may have a unitary structure and may be formed by, for example, injection molding. In alternative exemplary embodiments, dart cap 230 may be formed of one or more pieces.

As shown in FIGS. 17A and 17B, in the illustrated embodiment, dart cap 230 has a rounded, or dome shaped, top portion. In embodiments, the top portion of dart cap 230 may be substantially flat. In embodiments, the top of dart cap 230 may also be tapered, curved, such as in the shape of a spherical segment, spherical frustum, or spherical dome, or may have some other shape. Providing a taper or curved top that adds material to the top of dart 210 may enhance the aerodynamic profile of the dart cap to improve the speed and accuracy of the dart and lengthen the distance over which dart 210 can travel.

Figure 18A:
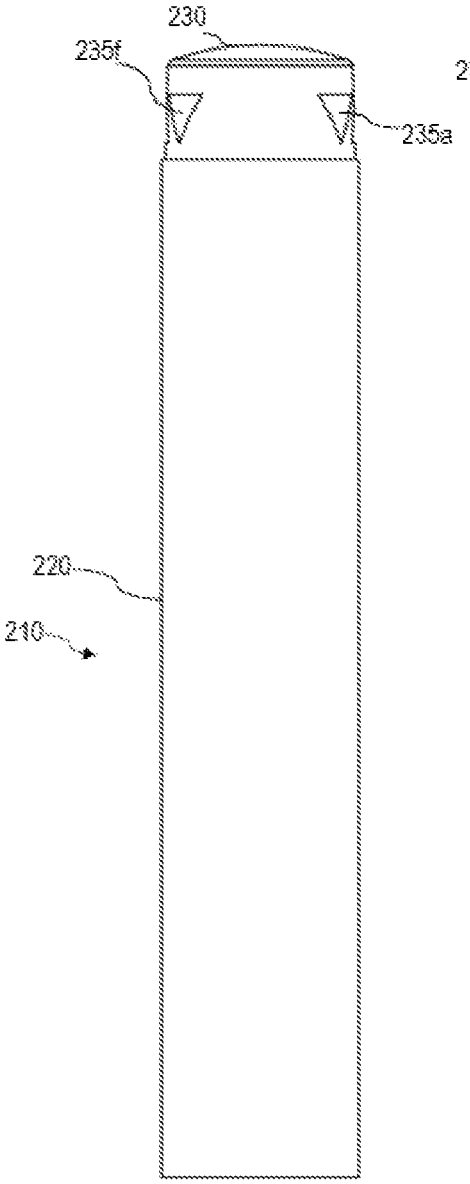
FIG. 18A is a plan view of the dart rotated 90 degrees clockwise from the angular orientation shown in FIG. 17A in accordance with a third exemplary embodiment of the present invention.
Figure 18B:
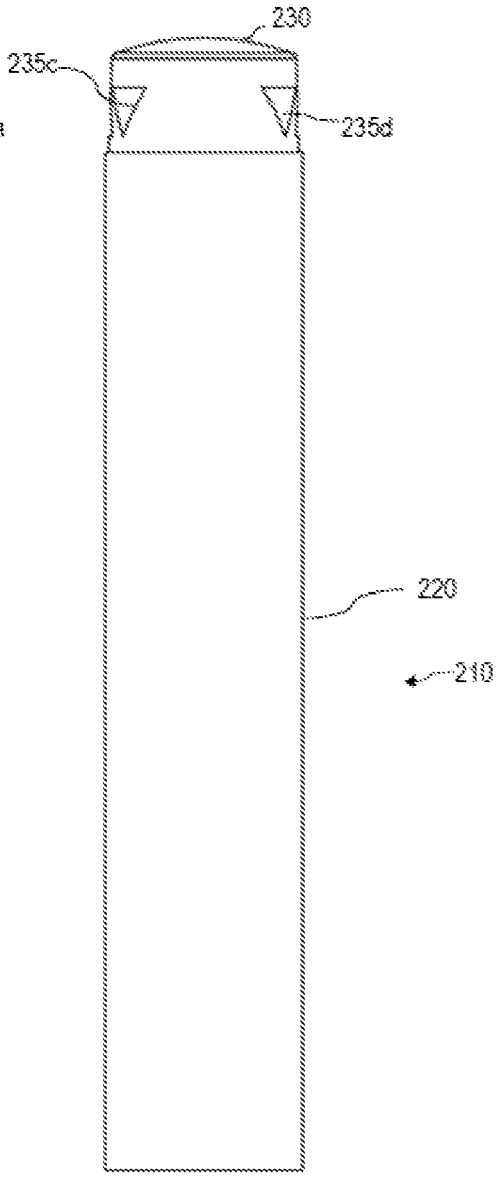
FIG. 18B is a plan view of the dart rotated 90 degrees counterclockwise from the angular orientation shown in FIG. 17A in accordance with a third exemplary embodiment of the present invention.

FIGS. 18A and 18B further illustrate the exemplary embodiment of the present invention, with FIG. 18A being a plan view of dart 210 rotated 90 degrees clockwise from the angular orientation shown in FIG. 17A and with FIG. 18B being a plan view of dart 210 rotated 90 degrees counterclockwise from the angular orientation shown in FIG. 17A. FIG. 18A shows the two ends of the hollow passage formed by apertures 235*f* and 235*a* as passing laterally across the side of dart cap 230. FIG. 18B shows the two ends of the hollow passage formed by apertures 235*c* and 235*d*, similarly passing laterally across the side of dart cap 230. In this view, the hollow passages formed by apertures 235*b* and 235*e* are not visible. Further, in contrast with the view of dart 210 from the angular orientations of FIGS. 17A and 17B, a viewer cannot see through dart cap 230 when viewing from the angular orientations shown in FIGS. 18A and 18B.

Figure 19B:
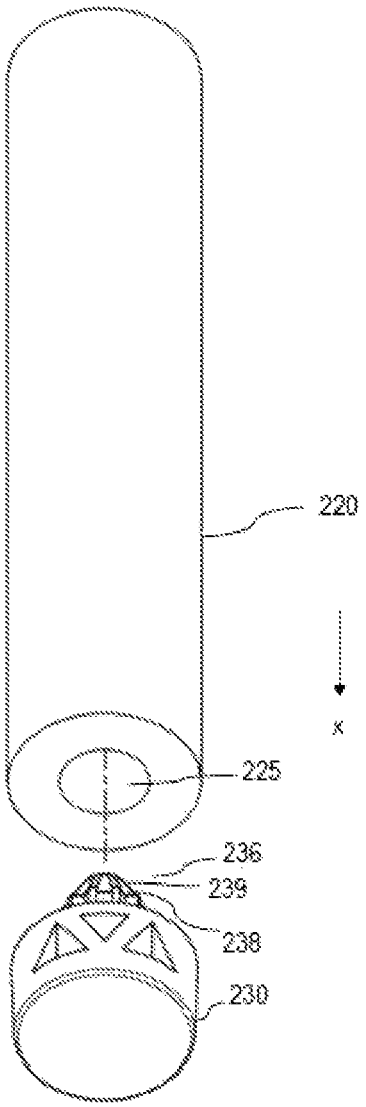
FIG. 19B is an exploded view of the dart, including a dart body and dart cap, shown from a second perspective with the dart cap in the orientation of FIG. 17A in accordance with a third exemplary embodiment of the present invention.

The exploded views of FIGS. 19A and 19B highlight additional features of dart cap 230. In particular, FIG. 19A illustrates a dart cap 230 that includes a stem 236 at the bottom of cap 230 that is insertable into interior bore 225 of dart body 220 to affix cap 230 to dart body 220. Stem 236 may be formed integrally with dart cap 230 or may be attached thereto, and may be formed of one or more pieces.

In embodiments, dart cap 230 is affixed to dart body 220 with an adhesive, such as a glue, that may be applied around stem 236, inside the interior bore 225, and/or to a bottom surface 237 of dart cap 230. To provide additional surface area on dart cap 230 to more strongly affix cap 230 to dart body 220, stem 236 may include one or more grooves, such as grooves 238 and 239 that can accommodate additional adhesive. In embodiments, dart cap 230 may be affixed to dart body 220 in a manner other than with an adhesive.

Although stem 236 is illustrated with a particular design, it should be understood that the stem 236 for dart cap 230 is not limited to the illustrated design, and may be shaped and/or sized differently. For example, there may not be any grooves and stem 236 may have an enlarged plug attached to the bottom of stem 236 to help hold stem 236 within interior bore 225.

Dart cap 230 is made to be heavier than the relatively lightweight configuration of dart body 220, such as by providing the various structures (e.g., exterior posts, interior walls, a thicker material top (e.g., dome shape)) and by choosing a particular composition of material, so as to position the center of gravity of dart 210 toward the head of the dart 210. This improves the accuracy and aerodynamics of dart 210.

Figure 20:
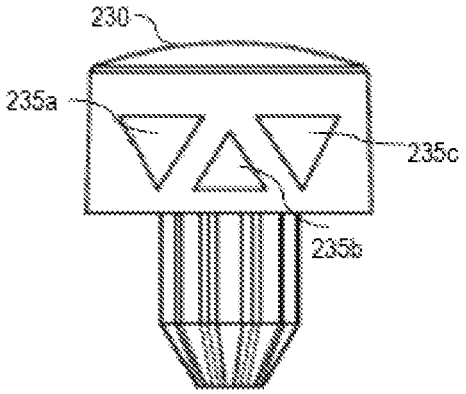
FIG. 20 is an enlarged plan view of the dart cap without the dart body shown in the orientation of FIG. 17A in accordance with a third exemplary embodiment of the present invention.
Figure 21:
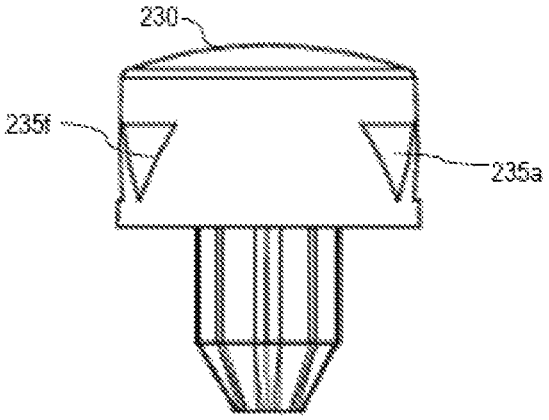
FIG. 21 is an enlarged plan view of the dart cap without the dart body shown in the orientation of FIG. 17B in accordance with a third exemplary embodiment of the present invention.

FIG. 20 shows an enlarged view of dart cap 230 with a first angular orientation as shown in FIG. 17A. FIG. 21 shows an enlarged view of dart cap 230 with a second angular orientation as shown in FIG. 18A. As shown in FIG. 20, the hollow passages defined by polygonal apertures 235*a*, 235*b*, and 235*c* allow a viewer to see through dart cap 230. In FIG. 21, however, which is a view of dart cap 230 in FIG. 17, but rotated by 90 degrees, the viewer cannot see completely through any of the hollow passages of dart cap 230. Rather, the viewer is able to see polygonal apertures 235*f* and 235*a*, which define two ends of a single hollow passage that passes through the solid interior of dart cap 230.

It should be understood that, as with the dimensions of elongate dart body 220, the dimensions of dart cap 230 and structures thereof may vary. For example, in embodiments, the height of dart cap 230 excluding the height of stem 236 may be in a range of 6-9 mm, stem 236 has a length, such as a length of at least 5 mm, and a diameter that is sized to fit and securely hold dart cap 230 within interior bore 225, and grooves 238, 239 within stem 236 may be in a range of 0.5 to 0.7 mm. However, in embodiments, dart cap 230 and structures thereof may have different dimensions, such as different lengths, heights, widths, and/or diameters.

In embodiments, dart cap 230 is made of a soft, flexible and/or resilient material, that can be injection molded. For example, dart cap 230 may be made of injection molded thermoplastic rubber (TPR). In embodiments, cap 230 could alternatively be made of, for example, polyvinyl chloride (PVC), styrene-butadiene-styrene (SBS), or ethylene-vinyl acetate (EVA), to name a few.

In embodiments, dart cap 230 has a Shore durometer measurement that is sufficiently rigid to maintain the integrity of the cap but relatively soft to lessen the impact on a target.

In embodiments, the molding material may have a Shore A durometer that is within a range of 15 to 80. In embodiments, the molding material may have a Shore A durometer that is within a range of 20 to 80, or a range of 20 to 70, or a range of 40 to 70, or a range of 20 to 60, or a range of 30 to 60, or a range of 20 to 40, to name a few. In embodiments, the molding material may have a Shore A durometer that is approximately 30, or approximately 40, or approximately 50, or approximately 70, to name a few. In embodiments, the molding material may have a Shore A durometer that is at least 20, or at least 30, or at least 40, to name a few. In embodiments, the molding material may have a Shore A durometer that is no more than 80, or no more than 70, or no more than 50, to name a few. In this context, approximate should be understood to be equal to the given measurement or a minor deviation from the given measurement.

In embodiments, cap 230 may have a Shore A durometer that is within a range of 15 to 80, or a range of 20 to 80, or a range of 20 to 70, or a range of 40 to 70, or a range of 20 to 60, or a range of 30 to 60, or a range of 20 to 40, to name a few. In embodiments, cap 230 may have a Shore A durometer that is approximately 30, or approximately 40, or approximately 50 or approximately 70, to name a few. In embodiments, cap 230 may have a Shore A durometer that is at least 20, or at least 30, or at least 40, to name a few. In embodiments, cap 230 may have a Shore A durometer that is no more than 80, or no more than 70 or no more than 50, to name a few. In this context, approximate should be understood to be equal to the given measurement or a minor deviation from the given measurement.

In embodiments, dart cap 230 may be measured along a different Shore durometer scale, such as Shore D, for example.

Figures 22, 23, 24:
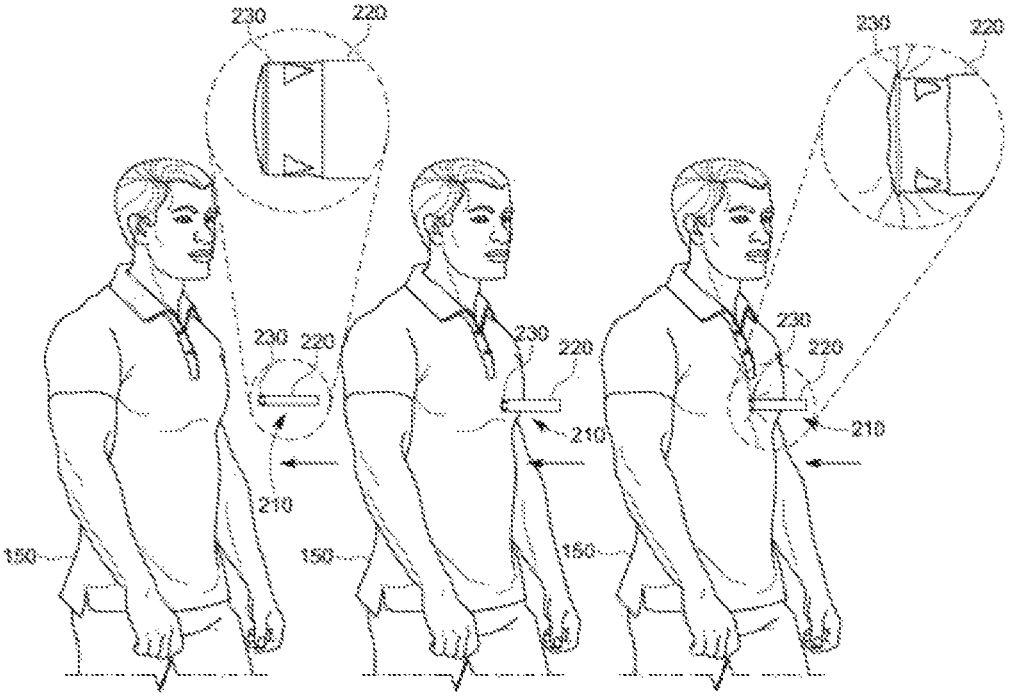
FIG. 22 shows the toy dart in accordance with a third embodiment of the invention on an incoming path toward a targeted person.
FIG. 23 shows the toy dart of FIG. 22 on initial impact on the person.
FIG. 24 shows an example of how the cap of the toy dart of FIG. 22 may deform upon impact.

FIGS. 22-24 illustrate an exemplary launch of dart 210 toward a person from a compatible toy dart launcher (not shown). The compatible toy dart launcher may launch dart 210 by forcing air or some other material, such as another gas or liquid, through the bottom of interior bore 225 at the tail end of elongate dart body 220, as shown in FIG. 19A. The forced air or other material impinges upon the bottom of stem 236 and causes the launch of the dart 210 toward a target. As an alternative to forced air or other material, dart 210 may be launched using motorized flywheels. As shown in FIG. 22, dart 210 has been launched and comes into proximity with a person 150. At FIG. 23, dart 210 impacts upon and makes contact with the person's shirt. At FIG. 24, dart 210 presses into person 150, with dart cap 230 deforming so as to safely soften the impact on the person and at least limit injuries that may be caused by the impact. As can be seen in the enlarged view within FIG. 24, the top portion of dart cap 230 deforms more than the bottom portion of dart cap 230 upon the initial impact of dart 210, with hollow passages defined by aperture pair 235*a* and 235*f* and 235*c* and 235*d* deforming more than the hollow passage defined by aperture pair 235*b* and 235*e*. After impacting the person, dart 210 bounces off and dart cap 230 may resiliently substantially return to its original shape, such as for relaunching. Also, as shown, the lightweight material, such as foam, of dart body 220 may also deform to a certain extent upon impact. It is desirable that the upper portion of dart cap 230 remain more rigid than the lower portion of dart cap 230 so that dart 210 does not wobble or deform much during flight, which would affect the accuracy of dart 210 in hitting its intended target.

Figure 25A:
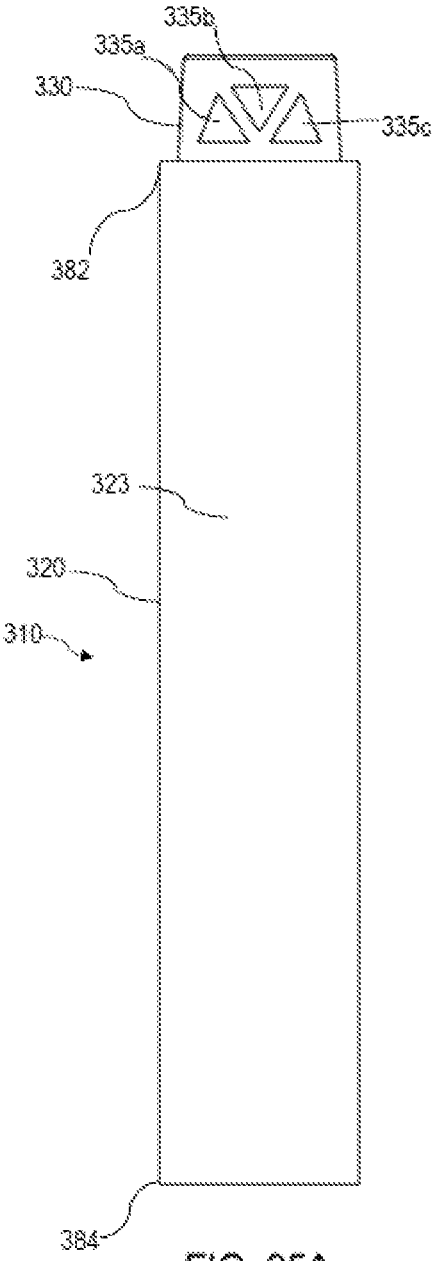
FIG. 25A is a plan view of a dart with a cap where the dart is displayed in a first angular orientation in accordance with a fourth exemplary embodiment of the present invention.

Referring to FIG. 25A, a dart 310 in accordance with exemplary embodiments of the present invention has an elongate profile configured for aerodynamic flight toward a target, such as toward a person or other object. In embodiments, dart 310 may have a length of about, e.g., within a range of 55 mm and 75 mm, such as 59 mm, 65 mm, 67 mm, 70 mm, 73 mm, or 74 mm, to name a few. In embodiments, dart 310 may have an outer cross-sectional diameter at its widest point of, for example, 12.5 mm, 13 mm, 14 mm, or 15 mm, to name a few. Further, in embodiments, dart 310 may have other lengths, widths, and/or diameters.

Figure 27A:
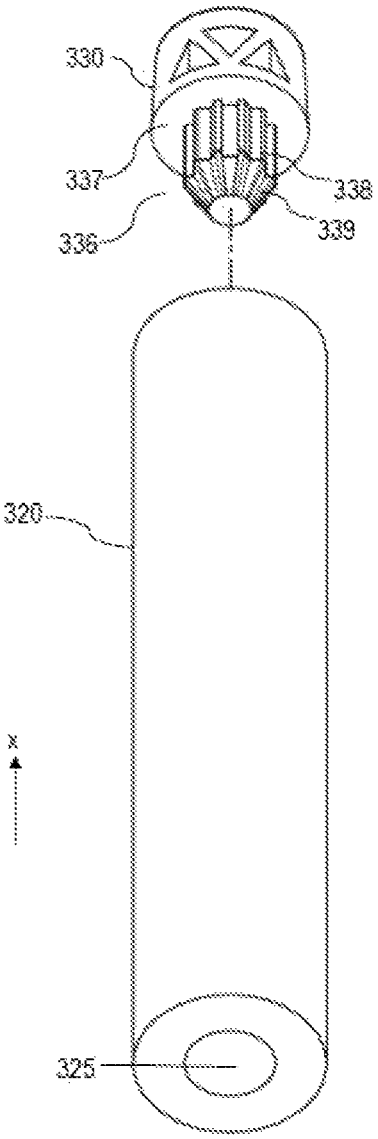
FIG. 27A is an exploded view of the dart, including a dart body and dart cap, shown from a first perspective with the dart cap in the orientation of FIG. 25A in accordance with a fourth exemplary embodiment of the present invention.

Dart 310 includes an elongate dart body 320 that extends from a first end (a head end) 382 to a second end (a tail end) 384 of the elongate dart body 320 in a first, longitudinal direction x (see FIG. 27A). Dart 310 further includes a dart cap 330 that is affixed to the head end of the dart body 320.

Elongate dart body 320 includes a lightweight material, such as a foam, that is suitable for use in a toy projectile and has an interior bore 325. Referring to FIGS. 25A and 27A, dart body 320 is illustrated as having, for example, an outer surface 323 that is substantially cylindrical in shape and interior bore 325 (or interior core) that is also cylindrical in shape with a circular cross-section. In embodiments, interior bore 325 may have a diameter that at its widest point is, for example, 5 mm, 5.5 mm, or 6 mm, to name a few. However, in embodiments, interior bore 325 may have a different diameter. Alternatively, elongate dart body 320 and/or interior bore 325 may have a different cross-sectional shape, such as an oval, pyramidal, diamond, heptagonal, or octagonal shape. Interior bore 325 may extend entirely or at least partially through dart body 320. In embodiments, interior bore 325 of dart body 320 may be lined with materials that provide dart body 320 with certain mechanical properties, e.g., rigidity or resiliency. In exemplary embodiments, the dart body 320 may be formed of one or more pieces.

Dart cap 330 is affixed to the head end of the dart body 320. In exemplary embodiments, dart cap 330 is cylindrical in shape and is solid. Dart cap 330 has a plurality of polygonal apertures 335*a*, 335*b*, 335*c*, 335*d*, 335*e*, 335*f* which are formed on its outer surface. As shown in FIG. 25A, the polygonal apertures 335*a*, 335*b*, and 335*c* are triangular in shape. In embodiments, polygonal aperture 335*b* is formed along a minor arc around the circumference of dart cap 330, where the minor arc extends between polygonal apertures 335*a* and 335*c*.

As shown in the embodiment of FIG. 25A, dart cap 330 is a tapered cylinder. That is, dart cap 330 has a circumference at its bottom portion, nearest to head end 382 of dart body 320, which is greater than the circumference of dart cap 330 closer to the top portion of the cap. Thus, in exemplary embodiments, dart cap 330 can be quasi conical in shape, or a truncated cone, tapering smoothly from the bottom portion of dart cap 330 to the top surface of dart cap 330.

Figure 25B:
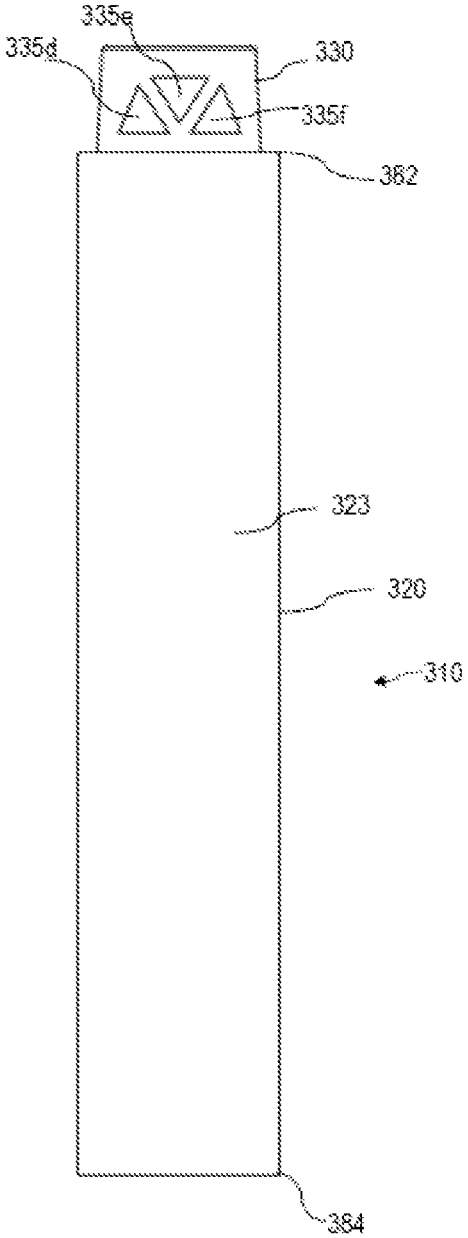
FIG. 25B is a plan view of the dart rotated 180 degrees from the angular orientation shown in FIG. 25A in accordance with a fourth exemplary embodiment of the present invention.

According to exemplary embodiments, each of polygonal apertures 335*a*, 335*b*, and 335*c* defines a first end of a hollow passage that passes through dart cap 330. FIG. 25B depicts a view of dart 310, which shows the dart rotated 180 degrees. In this view, an additional three polygonal apertures are shown: polygonal apertures 335*d*, 335*e*, and 335*f* Like the polygonal apertures depicted in FIG. 25A, each of polygonal apertures 335*d*, 335*e*, and 335*f* are formed on the outer surface of dart cap 330. Each of polygonal apertures 335*d*, 335*e*, and 335*f* define a second end of the hollow passages for which the polygonal apertures 335*a*-335*c* define respective first ends. Thus, according to embodiments, polygonal aperture 335*d* is a second end of the hollow passage that has a first end defined by polygonal aperture 335*c*, polygonal aperture 335*e* is a second end of the hollow passage that has its first end defined by polygonal aperture 335*b*, and polygonal aperture 335*f* is a second end of the hollow passage defined by polygonal aperture 335*a*.

As shown in FIGS. 25A and 25B, each of the hollow passages defined by their respective polygonal aperture pairs have a cross sectional area that is substantially the same in size, shape and orientation as the polygonal aperture at each end. Thus, for example, the hollow passage that corresponds to polygonal apertures 335*c* and 335*d* is substantially triangular in shape. Likewise, the hollow passage that corresponds to the other polygonal aperture pairs (335*a* and 335*f* and 335*b* and 335*e*) are substantially triangular in shape.

Other shapes for the polygonal apertures are contemplated and within the scope of the present invention. Further, as shown in FIGS. 25A and 25B, each of the triangular polygonal apertures 335*b* and 335*e* are inverted triangles, while polygonal apertures 335*a*, 335*c*, 335*d*, and 335*f* are upright triangles. That is, the hollow passages defined by apertures 335*b* and 335*e* are triangular having an apex at the bottom of the triangular passage, which is pointed at the bottom surface of dart cap 330. By contrast, the hollow passage defined by apertures 335*a*, 335*c*, 335*d*, and 335*f* are triangular having an apex at the top of the triangular passage, which is pointed at the top surface of dart cap 330. Other orientations for these apertures are possible and are within the scope of the present invention. In exemplary embodiments, the apertures may include multiple layers of apertures, with the size, shape and/or orientation of the apertures being the same or different from layer to layer.

In embodiments, the hollow passages defined by the aperture pairs extend through the interior of solid dart cap 330 and are substantially parallel to one another. Further, in embodiments, the triangle shaped hollow passages defined by aperture pair 335*a* and 335*f* and aperture pair 335*c* and 335*d* have a smaller cross sectional area than the hollow passage defined by aperture pair 335*b* and 335*e*. The hollow passages provide spaces that allow dart cap 330 to deform upon impact.

In exemplary embodiments, dart cap 330 may have a unitary structure and may be made by, for example, injection molding. In alternative exemplary embodiments, dart cap 330 may be formed of one or more pieces.

As shown in FIGS. 25A and 25B, in the illustrated embodiment, dart cap 330 has a flat top surface. In embodiments, the top surface of dart cap 330 may be tapered, curved, such as in the shape of a spherical segment, spherical frustum, or spherical dome, or may have some other shape. Providing a taper or curved top that adds material to the top of dart 310 may enhance the aerodynamic profile of the dart cap to improve the speed and accuracy of the dart and lengthen the distance over which dart 310 can travel.

Figure 26A:
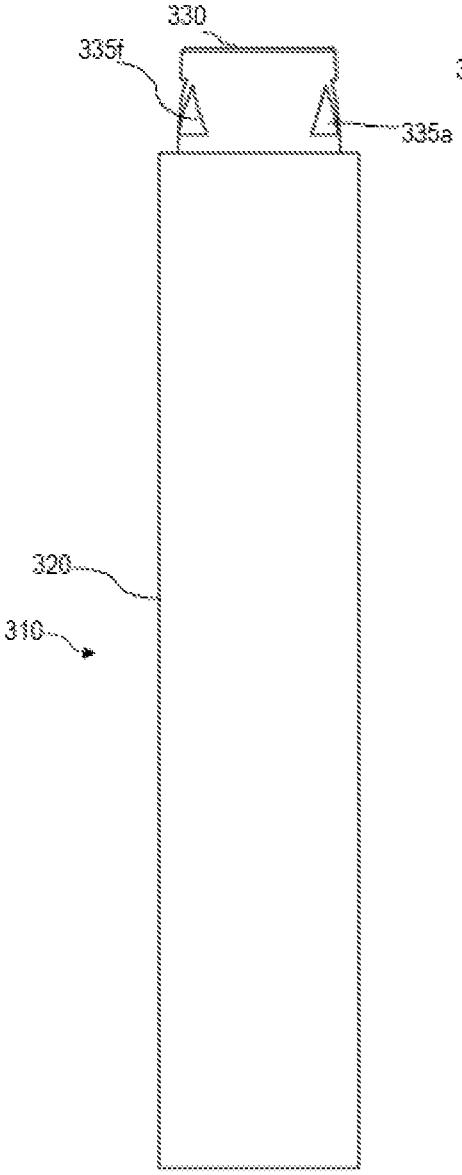
FIG. 26A is a plan view of the dart rotated 90 degrees clockwise from the angular orientation shown in FIG. 25A in accordance with a fourth exemplary embodiment of the present invention.
Figure 26B:
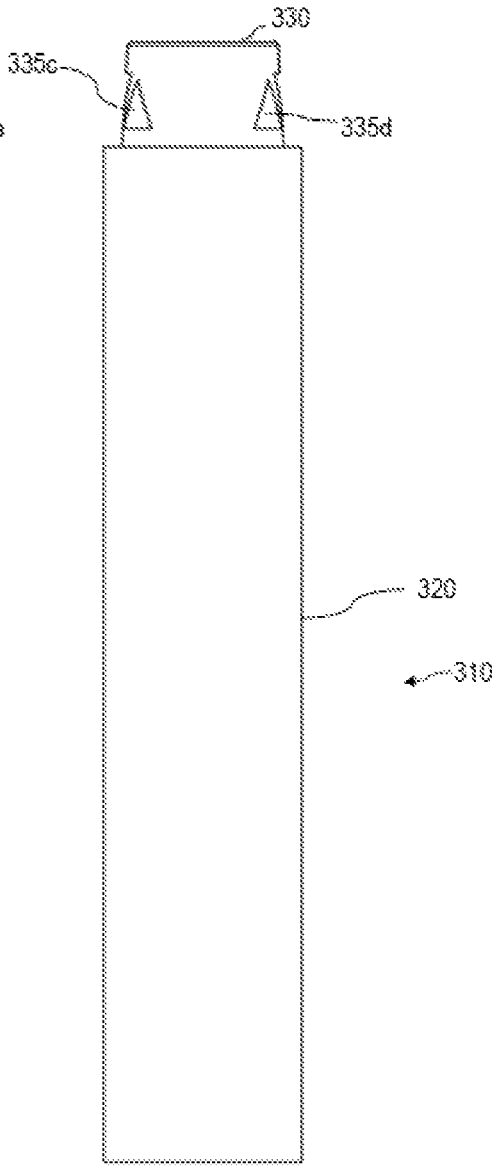
FIG. 26B is a plan view of the dart rotated 90 degrees counterclockwise from the angular orientation shown in FIG. 25A in accordance with a fourth exemplary embodiment of the present invention.

FIGS. 26A and 26B further illustrate the exemplary embodiment of the present invention, with FIG. 26A being a plan view of dart 310 rotated 90 degrees clockwise from the angular orientation shown in FIG. 25A and with FIG. 26B being a plan view of dart 310 rotated 90 degrees counterclockwise from the angular orientation shown in FIG. 25A. FIG. 26A shows the two ends of the hollow passage formed by apertures 335*f* and 335*a* as passing laterally across the side of dart cap 330. FIG. 26B shows the two ends of the hollow passage formed by apertures 335*c* and 335*d*, similarly passing laterally across the side of dart cap 330. In this view, the hollow passages formed by apertures 335*b* and 335*e* are not visible. Further, in contrast with the view of dart 310 from the angular orientations of FIGS. 25A and 25B, a viewer cannot see through dart cap 330 when viewing from the angular orientations shown in FIGS. 26A and 26B.

Figure 27B:
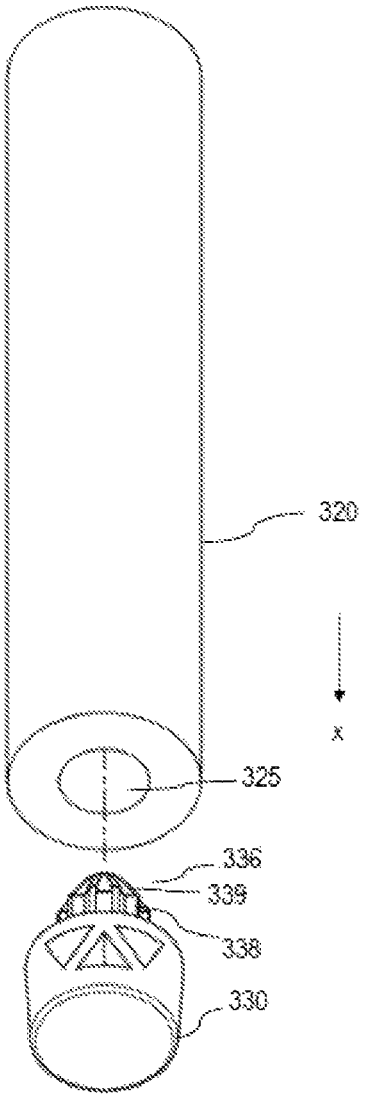
FIG. 27B is an exploded view of the dart, including a dart body and dart cap, shown from a second perspective with the dart cap in the orientation of FIG. 25A in accordance with a fourth exemplary embodiment of the present invention.

The exploded views of FIGS. 27A and 27B highlight additional features of dart cap 330. In particular, FIG. 27A illustrates a dart cap 330 that includes a stem 336 at the bottom of cap 330 that is insertable into interior bore 325 of dart body 320 to affix cap 330 to dart body 320. Stem 336 may be formed integrally with dart cap 330 or may be attached thereto, and may be formed of one or more pieces.

In embodiments, dart cap 330 is affixed to dart body 320 with an adhesive, such as a glue, that may be applied around stem 336, inside the interior bore 325, and/or to a bottom surface 337 of dart cap 330. To provide additional surface area on dart cap 330 to more strongly affix cap 330 to dart body 320, stem 336 may include one or more grooves, such as grooves 338 and 339 that can accommodate additional adhesive. In embodiments, dart cap 330 may be affixed to dart body 320 in a manner other than with an adhesive.

Although stem 336 is illustrated with a particular design, it should be understood that the stem 336 for dart cap 330 is not limited to the illustrated design, and may be shaped and/or sized differently. For example, there may not be any grooves and stem 336 may have an enlarged plug attached to the bottom of stem 336 to help hold stem 336 within interior bore 325.

Dart cap 330 is made to be heavier than the relatively lightweight configuration of dart body 320, such as by providing the various structures (e.g., exterior posts, interior walls, a thicker material top (e.g., dome shape)) and by choosing a particular composition of material, so as to position the center of gravity of dart 310 toward the head of the dart 310. This improves the accuracy and aerodynamics of dart 310.

Figure 28:
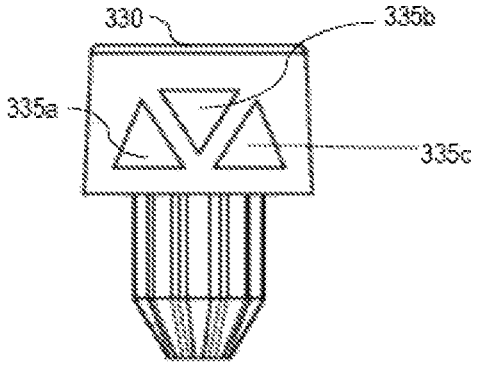
FIG. 28 is an enlarged plan view of the dart cap without the dart body shown in the orientation of FIG. 25A in accordance with a fourth exemplary embodiment of the present invention.
Figure 29:
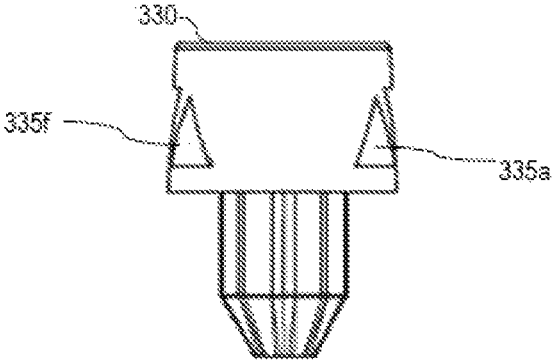
FIG. 29 is an enlarged plan view of the dart cap without the dart body shown in the orientation of FIG. 25B in accordance with a fourth exemplary embodiment of the present invention.

FIG. 28 shows an enlarged view of dart cap 330 with a first angular orientation as shown in FIG. 25A. FIG. 29 shows an enlarged view of dart cap 330 with a second angular orientation as shown in FIG. 26A. As shown in FIG. 28, the hollow passages defined by polygonal apertures 335*a*, 335*b*, and 335*c* allow a viewer to see through dart cap 330. In FIG. 29, however, which is a view of dart cap 330 in FIG. 28, but rotated by 90 degrees, the viewer cannot see completely through any of the hollow passages of dart cap 330. Rather, the viewer is able to see polygonal apertures 335*f* and 335*a*, which define two ends of a single hollow passage that passes through the solid interior of dart cap 330.

It should be understood that, as with the dimensions of elongate dart body 320, the dimensions of dart cap 330 and structures thereof may vary. For example, in embodiments, the height of dart cap 330 excluding the height of stem 336 may be in a range of 6-9 mm, stem 336 has a length, such as a length of at least 5 mm, and a diameter that is sized to fit and securely hold dart cap 330 within interior bore 325, and grooves 338, 339 within stem 336 may be in a range of 0.5 to 0.7 mm. However, in embodiments, dart cap 330 and structures thereof may have different dimensions, such as different lengths, heights, widths, and/or diameters.

In embodiments, dart cap 330 is made of a soft, flexible and/or resilient material, that can be injection molded. For example, dart cap 330 may be made of injection molded thermoplastic rubber (TPR). In embodiments, cap 330 could alternatively be made of, for example, polyvinyl chloride (PVC), styrene-butadiene-styrene (SBS), or ethylene-vinyl acetate (EVA), to name a few.

In embodiments, dart cap 330 has a Shore durometer measurement that is sufficiently rigid to maintain the integrity of the cap but relatively soft to lessen the impact on a target.

In embodiments, the molding material may have a Shore A durometer that is within a range of 15 to 80. In embodiments, the molding material may have a Shore A durometer that is within a range of 20 to 80, or a range of 20 to 70, or a range of 40 to 70, or a range of 20 to 60, or a range of 30 to 60, or a range of 20 to 40, to name a few. In embodiments, the molding material may have a Shore A durometer that is approximately 30, or approximately 40, or approximately 50, or approximately 70, to name a few. In embodiments, the molding material may have a Shore A durometer that is at least 20, or at least 30, or at least 40, to name a few. In embodiments, the molding material may have a Shore A durometer that is no more than 80, or no more than 70, or no more than 50, to name a few. In this context, approximate should be understood to be equal to the given measurement or a minor deviation from the given measurement.

In embodiments, cap 330 may have a Shore A durometer that is within a range of 15 to 80, or a range of 20 to 80, or a range of 20 to 70, or a range of 40 to 70, or a range of 20 to 60, or a range of 30 to 60, or a range of 20 to 40, to name a few. In embodiments, cap 330 may have a Shore A durometer that is approximately 30, or approximately 40, or approximately 50 or approximately 70, to name a few. In embodiments, cap 330 may have a Shore A durometer that is at least 20, or at least 30, or at least 40, to name a few. In embodiments, cap 330 may have a Shore A durometer that is no more than 80, or no more than 70 or no more than 50, to name a few. In this context, approximate should be understood to be equal to the given measurement or a minor deviation from the given measurement.

In embodiments, dart cap 330 may be measured along a different Shore durometer scale, such as Shore D, for example.

Figures 30, 31, 32:
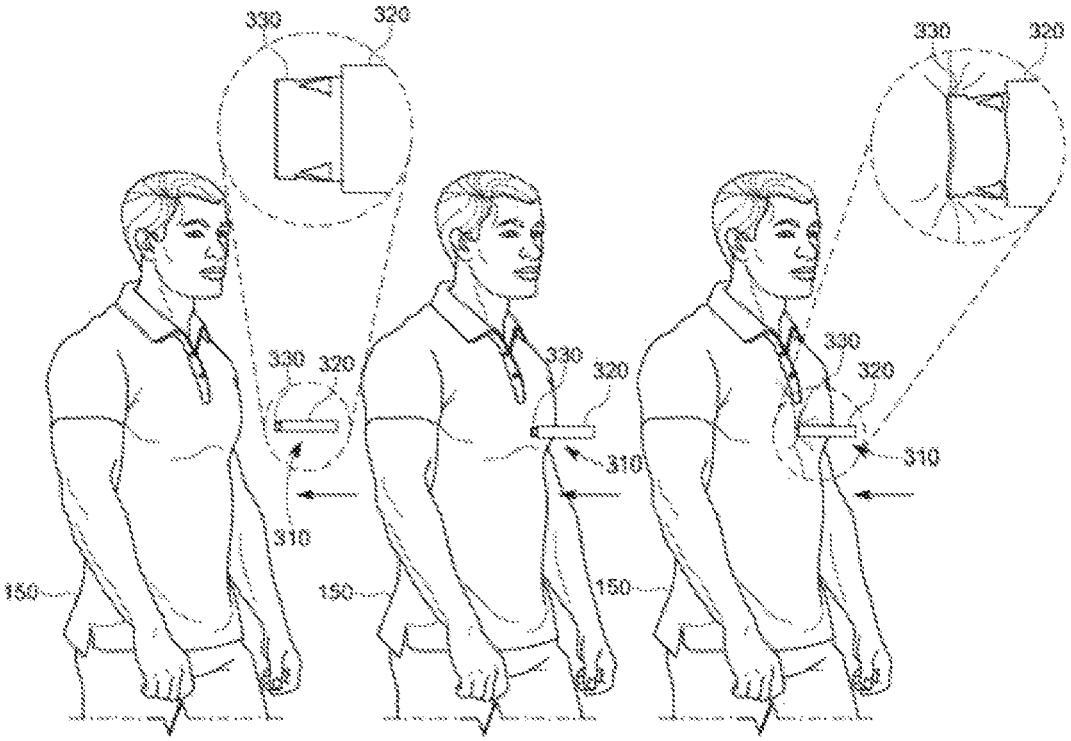
FIG. 30 shows the toy dart in accordance with a fourth exemplary embodiment of the invention on an incoming path toward a targeted person.
FIG. 31 shows the toy dart of FIG. 30 on initial impact on the person.
FIG. 32 shows an example of how the cap of the toy dart of FIG. 30 may deform upon impact.

FIGS. 30-32 illustrate an exemplary launch of dart 310 toward a person from a compatible toy dart launcher (not shown). The compatible toy dart launcher may launch dart 310 by forcing air or some other material, such as another gas or liquid, through the bottom of interior bore 325 at the tail end of elongate dart body 320, as shown in FIG. 27. The forced air or other material impinges upon the bottom of stem 336 and causes the launch of the dart 310 toward a target. As an alternative to forced air or other material, dart 310 may be launched using motorized flywheels. As shown in FIG. 30, dart 310 has been launched and comes into proximity with a person 150. At FIG. 31, dart 310 impacts upon and makes contact with the person's shirt. At FIG. 32, dart 310 presses into person 150, with dart cap 330 deforming so as to safely soften the impact on the person and at least limit injuries that may be caused by the impact. As can be seen in the enlarged view within FIG. 32, the top portion of dart cap 330 deforms more than the bottom portion of dart cap 330 upon the initial impact of dart 310, with hollow passage defined by aperture pair 335*b* and 335*e* deforming more than the hollow passages defined by aperture pair 335*a* and 335*f* and aperture pair 335*c* and 335*d*. After impacting the person, dart 310 bounces off and dart cap 330 may resiliently substantially return to its original shape, such as for relaunching. Also, as shown, the lightweight material, such as foam, of dart body 320 may also deform to a certain extent upon impact. It is desirable that the upper portion of dart cap 330 remain more rigid than the lower portion of dart cap 330 so that dart 310 does not wobble or deform much during flight, which would affect the accuracy of dart 310 in hitting its intended target.

Figure 33A:
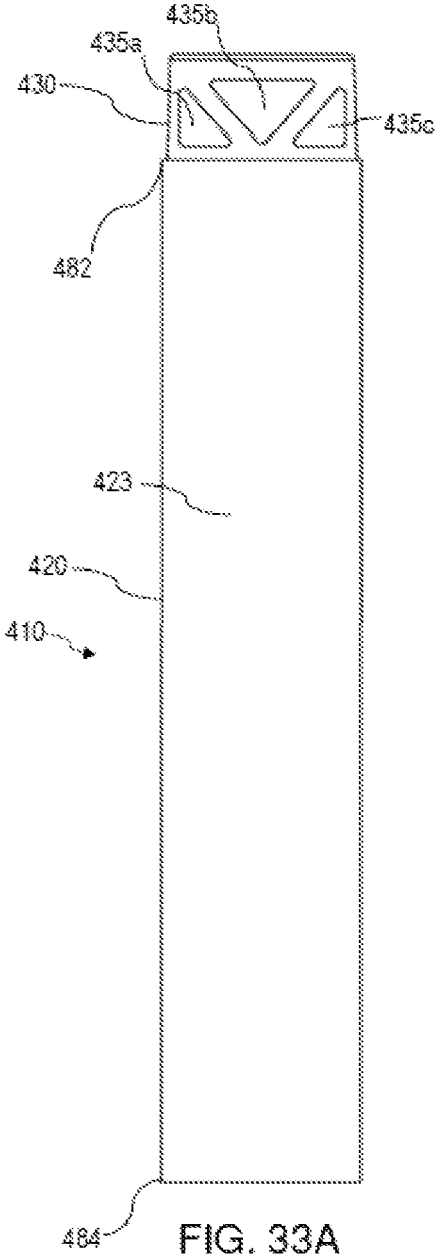
FIG. 33A is a plan view of a dart with a cap where the dart is displayed in a first angular orientation in accordance with a fifth exemplary embodiment of the present invention.

Referring to FIG. 33A, a dart 410 in accordance with exemplary embodiments of the present invention has an elongate profile configured for aerodynamic flight toward a target, such as toward a person or other object. In embodiments, dart 410 may have a length of about, e.g., within a range of 55 mm and 75 mm, such as 59 mm, 65 mm, 67 mm, 70 mm, 73 mm, or 74 mm, to name a few. In embodiments, dart 410 may have an outer cross-sectional diameter at its widest point of, for example, 12.5 mm, 13 mm, 14 mm, or 15 mm, to name a few. Further, in embodiments, dart 410 may have other lengths, widths, and/or diameters.

Figure 35A:
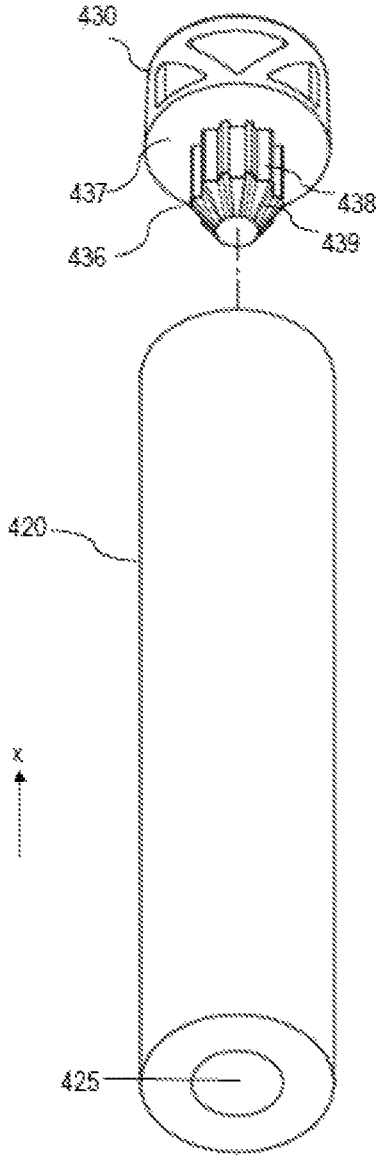
FIG. 35A is an exploded view of the dart, including a dart body and dart cap, shown from a first perspective with the dart cap in the orientation of FIG. 33A in accordance with a fifth exemplary embodiment of the present invention.

Dart 410 includes an elongate dart body 420 that extends from a first end (a head end) 482 to a second end (a tail end) 484 of the elongate dart body 420 in a first, longitudinal direction x (see FIG. 35A). Dart 410 further includes a dart cap 430 that is affixed to the head end of the dart body 420.

Elongate dart body 420 includes a lightweight material, such as a foam, that is suitable for use in a toy projectile and has an interior bore 425. Referring to FIGS. 33A and 35A, dart body 420 is illustrated as having, for example, an outer surface 423 that is substantially cylindrical in shape and interior bore 425 (or interior core) that is also cylindrical in shape with a circular cross-section. In embodiments, interior bore 425 may have a diameter that at its widest point is, for example, 5 mm, 5.5 mm, or 6 mm, to name a few. However, in embodiments, interior bore 425 may have a different diameter. Alternatively, elongate dart body 420 and/or interior bore 425 may have a different cross-sectional shape, such as an oval, pyramidal, diamond, heptagonal, or octagonal shape. Interior bore 425 may extend entirely or at least partially through dart body 420. In embodiments, interior bore 425 of dart body 420 may be lined with materials that provide dart body 420 with certain mechanical properties, e.g., rigidity or resiliency. In exemplary embodiments, the dart body 420 may be formed of one or more pieces.

Dart cap 430 is affixed to the head end of the dart body 420. In exemplary embodiments, dart cap 430 is cylindrical in shape and is solid. Dart cap 430 has a plurality of polygonal apertures 435*a*, 435*b*, 435*c*, 435*d*, 435*e*, 435*f* which are formed on its outer surface. As shown in FIG. 33A, the polygonal apertures 435*a*, 435*b*, and 435*c* are triangular in shape. In embodiments, polygonal aperture 435*b* is formed along a minor arc around the circumference of dart cap 430, where the minor arc extends between polygonal apertures 435*a* and 435*c*.

As shown in the embodiment of FIG. 33A, dart cap 430 is cylindrical in shape. In other embodiments, dart cap 430 can also be a tapered cylinder. That is, in such embodiments, dart cap 430 has a circumference at its bottom portion, nearest to head end 482 of dart body 420, which is greater than the circumference of dart cap 430 closer to the top portion of the cap. Thus, in exemplary embodiments, dart cap 430 can be quasi conical in shape, or a truncated cone, tapering smoothly from the bottom portion of dart cap 430 to the top surface of dart cap 430.

Figure 33B:
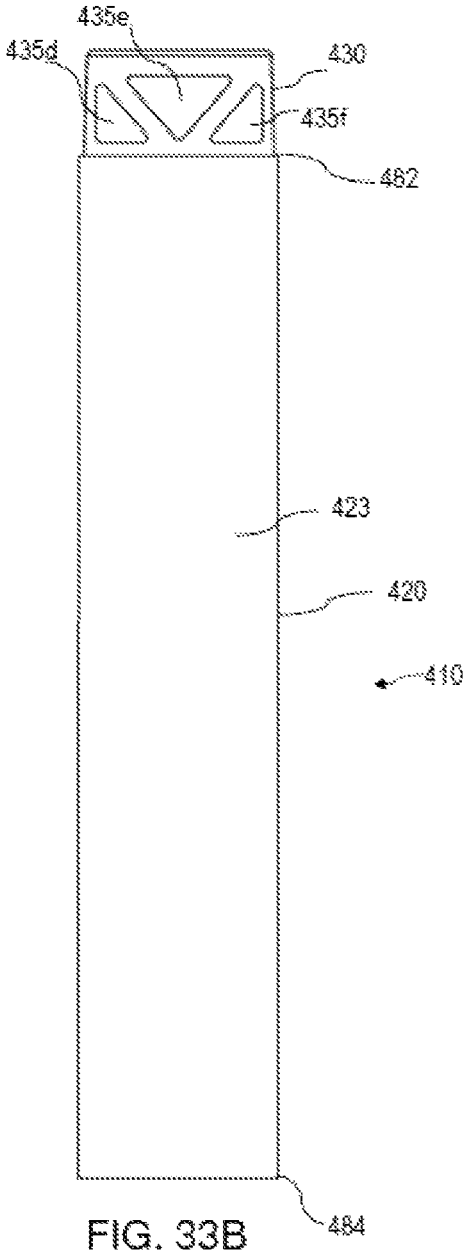
FIG. 33B is a plan view of the dart rotated 180 degrees from the angular orientation shown in FIG. 33A in accordance with a fifth exemplary embodiment of the present invention.

According to exemplary embodiments, each of polygonal apertures 435*a*, 435*b*, and 435*c* defines a first end of a hollow passage that passes through dart cap 430. FIG. 33B depicts a view of dart 410, which shows the dart rotated 180 degrees. In this view, an additional three polygonal apertures are shown: polygonal apertures 435*d*, 435*e*, and 435*f*. Like the polygonal apertures depicted in FIG. 33A, each of polygonal apertures 435*d*, 435*e*, and 435*f* are formed on the outer surface of dart cap 430. Each of polygonal apertures 435*d*, 435*e*, and 435*f* define a second end of the hollow passages for which the polygonal apertures 435*a*-435*c* define respective first ends. Thus, according to embodiments, polygonal aperture 435*d* is a second end of the hollow passage that has a first end defined by polygonal aperture 435*c*, polygonal aperture 435*e* is a second end of the hollow passage that has its first end defined by polygonal aperture 435*b*, and polygonal aperture 435*f* is a second end of the hollow passage defined by polygonal aperture 435*a*.

As shown in FIGS. 33A and 33B, each of the hollow passages defined by their respective polygonal aperture pairs have a cross sectional area that is substantially the same in size, shape and orientation as the polygonal aperture at each end. Thus, for example, the hollow passage that corresponds to polygonal apertures 435*c* and 435*d* is substantially triangular in shape. Likewise, the hollow passage that corresponds to the other polygonal aperture pairs (435*a* and 435*f* and 435*b* and 435*e*) are substantially triangular in shape. Other shapes for the polygonal apertures are contemplated and within the scope of the present invention. Further, as shown in FIG. 33A, triangular polygonal aperture 435*b* is an inverted triangle, while polygonal apertures 435*a* and 435*c* are opposite facing right triangles, where the hypotenuse of each right triangle directly faces a side of triangular polygonal aperture 435*b*. Thus, the hollow passages defined by apertures 435*a* and 435*c* are right triangles having a hypotenuse which faces a side of triangular polygonal aperture 435*b*. The hollow passage defined by aperture 435*b* is triangular having an apex at the bottom of the triangular passage, which is pointed at the bottom surface of dart cap 430. Similarly, as shown in FIG. 33B, triangular polygonal aperture 435*e* is an inverted triangle, while polygonal apertures 435*d* and 435*f* are opposite facing right triangles, where the hypotenuse of each right triangle directly faces a side of triangular polygonal aperture 435*e*. Thus, the hollow passages defined by apertures 435*d* and 435*f* are right triangles having a hypotenuse which faces a side of triangular polygonal aperture 435*e*. The hollow passage defined by aperture 435*e* is triangular having an apex at the bottom of the triangular passage, which is pointed at the bottom surface of dart cap 430. Other orientations for these apertures are possible and are within the scope of the present invention. In exemplary embodiments, the apertures may include multiple layers of apertures, with the size, shape and/or orientation of the apertures being the same or different from layer to layer.

In embodiments, the hollow passages defined by the aperture pairs extend through the interior of solid dart cap 430 and are substantially parallel to one another. Further, in embodiments, the triangle shaped hollow passages defined by aperture pair 435*a* and 435*f* and aperture pair 435*c* and 435*d* have a smaller cross sectional area than the hollow passage defined by aperture pair 435*b* and 435*e*. The hollow passages provide spaces that allow dart cap 430 to deform upon impact.

In exemplary embodiments, dart cap 430 may have a unitary structure and may be made by, for example, injection molding. In alternative exemplary embodiments, dart cap 430 may be formed of one or more pieces.

As shown in FIGS. 33A and 33B, in the illustrated embodiment, dart cap 430 has a flat top surface. In embodiments, the top surface of dart cap 430 may be tapered, curved, such as in the shape of a spherical segment, spherical frustum, or spherical dome, or may have some other shape. Providing a taper or curved top that adds material to the top of dart 410 may enhance the aerodynamic profile of the dart cap to improve the speed and accuracy of the dart and lengthen the distance over which dart 410 can travel.

Figure 34A:
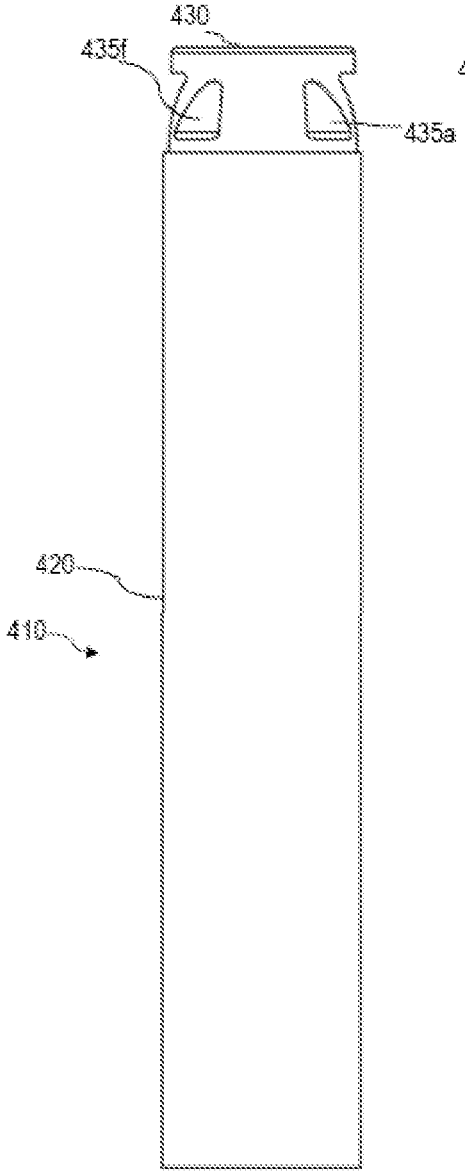
FIG. 34A is a plan view of the dart rotated 90 degrees clockwise from the angular orientation shown in FIG. 33A in accordance with a fifth exemplary embodiment of the present invention.
Figure 34B:
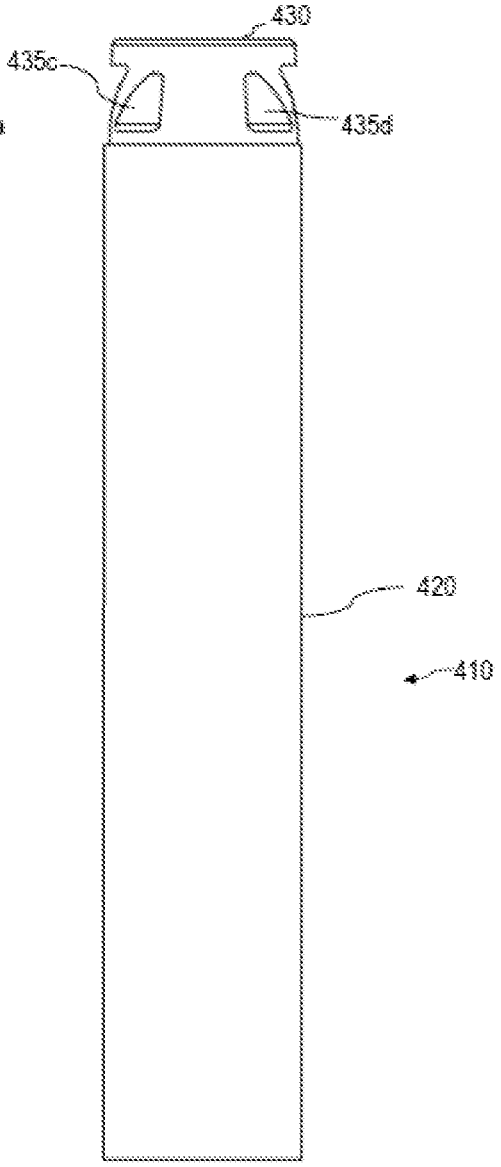
FIG. 34B is a plan view of the dart rotated 90 degrees counterclockwise from the angular orientation shown in FIG. 33A in accordance with a fifth exemplary embodiment of the present invention.

FIGS. 34A and 34B further illustrate the exemplary embodiment of the present invention, with FIG. 33A being a plan view of dart 410 rotated 90 degrees clockwise from the angular orientation shown in FIG. 33A and with FIG. 34B being a plan view of dart 410 rotated 90 degrees counterclockwise from the angular orientation shown in FIG. 33A. FIG. 34A shows the two ends of the hollow passage formed by apertures 435*f* and 435*a* as passing laterally across the side of dart cap 430. FIG. 34B shows the two ends of the hollow passage formed by apertures 435*c* and 435*d*, similarly passing laterally across the side of dart cap 430. In this view, the hollow passages formed by apertures 435*b* and 435*e* are not visible. Further, in contrast with the view of dart 410 from the angular orientations of FIGS. 33A and 33B, a viewer cannot see through dart cap 430 when viewing from the angular orientations shown in FIGS. 34A and 34B.

Figure 35B:
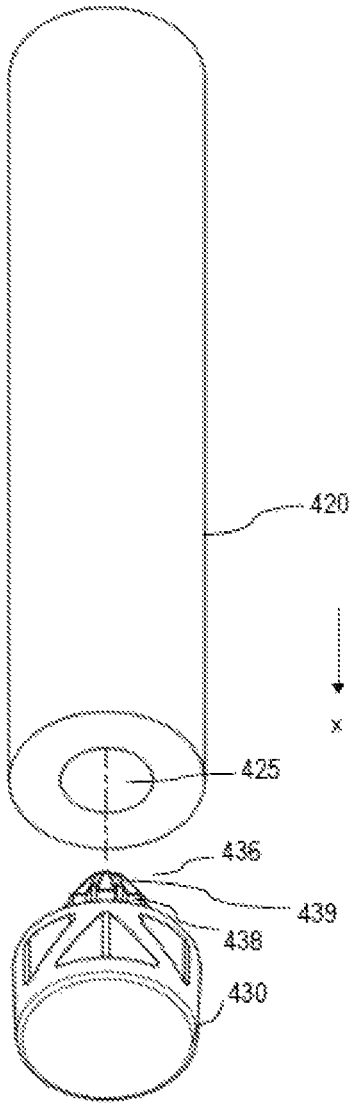
FIG. 35B is an exploded view of the dart, including a dart body and dart cap, shown from a second perspective with the dart cap in the orientation of FIG. 33A in accordance with a fifth exemplary embodiment of the present invention.

The exploded views of FIGS. 35A and 35B highlight additional features of dart cap 430. In particular, FIG. 35A illustrates a dart cap 430 that includes a stem 436 at the bottom of cap 430 that is insertable into interior bore 425 of dart body 420 to affix cap 430 to dart body 420. Stem 436 may be formed integrally with dart cap 430 or may be attached thereto, and may be formed of one or more pieces.

In embodiments, dart cap 430 is affixed to dart body 420 with an adhesive, such as a glue, that may be applied around stem 436, inside the interior bore 425, and/or to a bottom surface 437 of dart cap 430. To provide additional surface area on dart cap 430 to more strongly affix cap 430 to dart body 420, stem 436 may include one or more grooves, such as grooves 438 and 439 that can accommodate additional adhesive. In embodiments, dart cap 430 may be affixed to dart body 420 in a manner other than with an adhesive.

Although stem 436 is illustrated with a particular design, it should be understood that the stem 436 for dart cap 430 is not limited to the illustrated design and may be shaped and/or sized differently. For example, there may not be any grooves and stem 436 may have an enlarged plug attached to the bottom of stem 436 to help hold stem 436 within interior bore 425.

Dart cap 430 is made to be heavier than the relatively lightweight configuration of dart body 420, such as by providing the various structures (e.g., exterior posts, interior walls, a thicker material top (e.g., dome shape)) and by choosing a particular composition of material, so as to position the center of gravity of dart 410 toward the head of the dart 410. This improves the accuracy and aerodynamics of dart 410.

Figure 36:
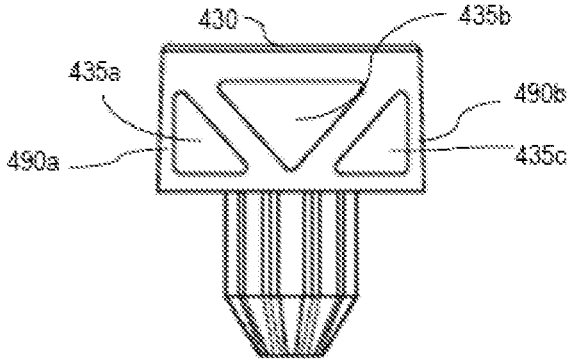
FIG. 36 is an enlarged plan view of the dart cap without the dart body shown in the orientation of FIG. 33A in accordance with a fifth exemplary embodiment of the present invention.
Figure 37:
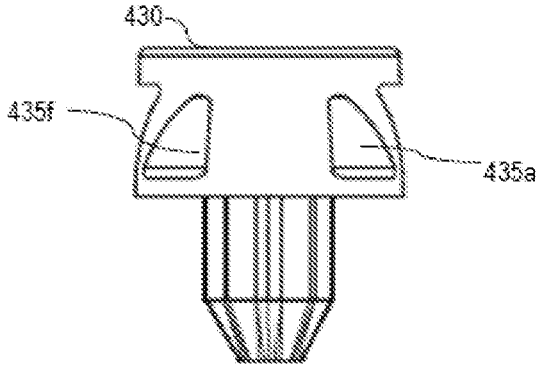
FIG. 37 is an enlarged plan view of the dart cap without the dart body shown in the orientation of FIG. 33B in accordance with a fifth exemplary embodiment of the present invention.

FIG. 36 shows an enlarged view of dart cap 430 with a first angular orientation as shown in FIG. 33A. FIG. 37 shows an enlarged view of dart cap 430 with a second angular orientation as shown in FIG. 34A. As shown in FIG. 36, the hollow passages defined by polygonal apertures 435*a*, 435*b*, and 435*c* allow a viewer to see through dart cap 430. In FIG. 37, however, which is a view of dart cap 430 in FIG. 36, but rotated by 90 degrees, the viewer cannot see completely through any of the hollow passages of dart cap 430. Rather, the viewer is able to see polygonal apertures 435*f* and 435*a*, which define two ends of a single hollow passage that passes through the solid interior of dart cap 430.

Further, as shown in FIGS. 36 and 37, the outer surfaces of polygonal apertures 435*a*, 435*c*, 435*d* and 435*f* are defined by substantially vertically extending posts 490*a* and 490*b*.

It should be understood that, as with the dimensions of elongate dart body 420, the dimensions of dart cap 430 and structures thereof may vary. For example, in embodiments, the height of dart cap 430 excluding the height of stem 436 may be in a range of 6-9 mm, stem 436 has a length, such as a length of at least 5 mm, and a diameter that is sized to fit and securely hold dart cap 430 within interior bore 425, and grooves 438, 439 within stem 436 may be in a range of 0.5 to 0.7 mm. However, in embodiments, dart cap 430 and structures thereof may have different dimensions, such as different lengths, heights, widths, and/or diameters.

In embodiments, dart cap 430 is made of a soft, flexible and/or resilient material, that can be injection molded. For example, dart cap 430 may be made of injection molded thermoplastic rubber (TPR). In embodiments, cap 430 could alternatively be made of, for example, polyvinyl chloride (PVC), styrene-butadiene-styrene (SBS), or ethylene-vinyl acetate (EVA), to name a few.

In embodiments, dart cap 430 has a Shore durometer measurement that is sufficiently rigid to maintain the integrity of the cap but relatively soft to lessen the impact on a target.

In embodiments, the molding material may have a Shore A durometer that is within a range of 15 to 80. In embodiments, the molding material may have a Shore A durometer that is within a range of 20 to 80, or a range of 20 to 70, or a range of 40 to 70, or a range of 20 to 60, or a range of 30 to 60, or a range of 20 to 40, to name a few. In embodiments, the molding material may have a Shore A durometer that is approximately 30, or approximately 40, or approximately 50, or approximately 70, to name a few. In embodiments, the molding material may have a Shore A durometer that is at least 20, or at least 30, or at least 40, to name a few. In embodiments, the molding material may have a Shore A durometer that is no more than 80, or no more than 70, or no more than 50, to name a few. In this context, approximate should be understood to be equal to the given measurement or a minor deviation from the given measurement.

In embodiments, cap 430 may have a Shore A durometer that is within a range of 15 to 80, or a range of 20 to 80, or a range of 20 to 70, or a range of 40 to 70, or a range of 20 to 60, or a range of 30 to 60, or a range of 20 to 40, to name a few. In embodiments, cap 430 may have a Shore A durometer that is approximately 30, or approximately 40, or approximately 50 or approximately 70, to name a few. In embodiments, cap 430 may have a Shore A durometer that is at least 20, or at least 30, or at least 40, to name a few. In embodiments, cap 430 may have a Shore A durometer that is no more than 80, or no more than 70 or no more than 50, to name a few. In this context, approximate should be understood to be equal to the given measurement or a minor deviation from the given measurement.

In embodiments, dart cap 430 may be measured along a different Shore durometer scale, such as Shore D, for example.

Figures 38, 39, 40:
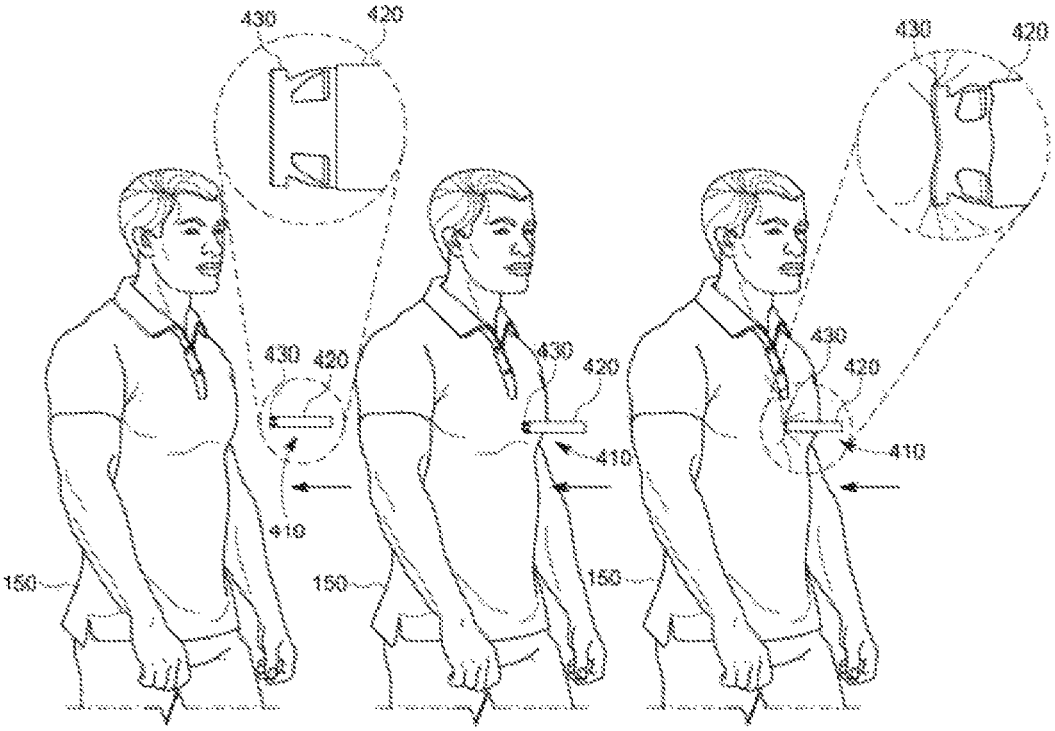
FIG. 38 shows the toy dart in accordance with a fifth exemplary embodiment of the invention on an incoming path toward a targeted person.
FIG. 39 shows the toy dart of FIG. 38 on initial impact on the person.
FIG. 40 shows an example of how the cap of the toy dart of FIG. 38 may deform upon impact.

FIGS. 38-40 illustrate an exemplary launch of dart 410 toward a person from a compatible toy dart launcher (not shown). The compatible toy dart launcher may launch dart 410 by forcing air or some other material, such as another gas or liquid, through the bottom of interior bore 425 at the tail end of elongate dart body 420, as shown in FIG. 35A. The forced air or other material impinges upon the bottom of stem 436 and causes the launch of the dart 410 toward a target. As an alternative to forced air or other material, dart 410 may be launched using motorized flywheels. As shown in FIG. 38, dart 410 has been launched and comes into proximity with a person 150. At FIG. 39, dart 410 impacts upon and makes contact with the person's shirt. At FIG. 40, dart 410 presses into person 150, with dart cap 430 deforming so as to safely soften the impact on the person and at least limit injuries that may be caused by the impact. As can be seen in the enlarged view within FIG. 40, the top portion of dart cap 430 deforms more than the bottom portion of dart cap 430 upon the initial impact of dart 410, with hollow passage defined by aperture pair 435*b* and 435*e* deforming more than the hollow passages defined by aperture pair 435*a* and 435*f* and aperture pair 435*c* and 435*d*. After impacting the person, dart 410 bounces off and dart cap 430 may resiliently substantially return to its original shape, such as for relaunching. Also, as shown, the lightweight material, such as foam, of dart body 420 may also deform to a certain extent upon impact. It is desirable that the upper portion of dart cap 430 remain more rigid than the lower portion of dart cap 430 so that dart 410 does not wobble or deform much during flight, which would affect the accuracy of dart 410 in hitting its intended target.

Figure 41A:
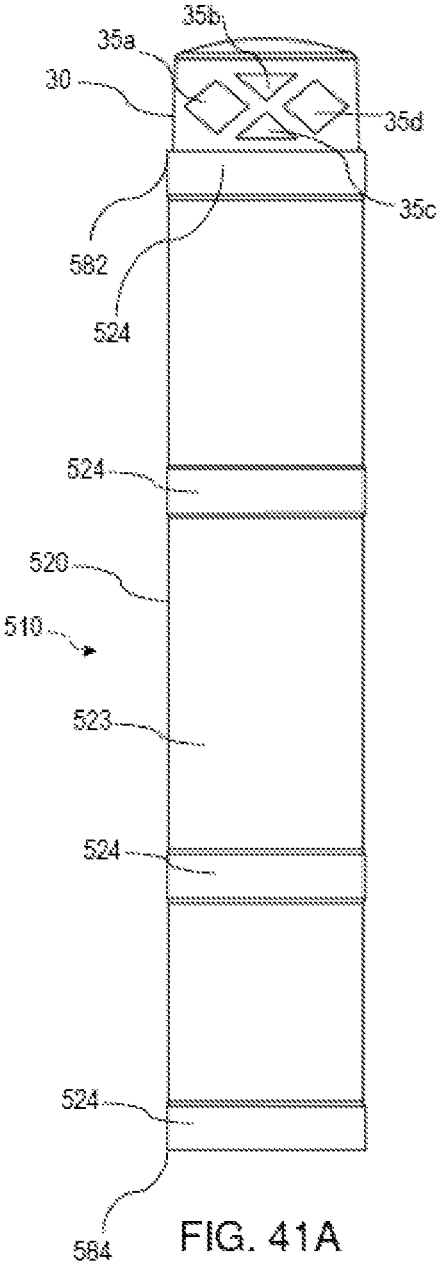
FIG. 41A is a plan view of a dart having ridges formed thereon with a cap where the dart is displayed in a first angular orientation in accordance with a sixth exemplary embodiment of the present invention.

Referring to FIG. 41A, a dart 510 in accordance with exemplary embodiments of the present invention has an elongate profile configured for aerodynamic flight toward a target, such as toward a person or other object. In embodiments, dart 510 may have a length of about, e.g., within a range of 55 mm and 75 mm, such as 59 mm, 65 mm, 67 mm, 70 mm, 73 mm, or 74 mm, to name a few. In embodiments, dart 510 may have an outer cross-sectional diameter at its widest point of, for example, 12.5 mm, 13 mm, 14 mm, or 15 mm, to name a few. Further, in embodiments, dart 510 may have other lengths, widths, and/or diameters.

Figure 43A:
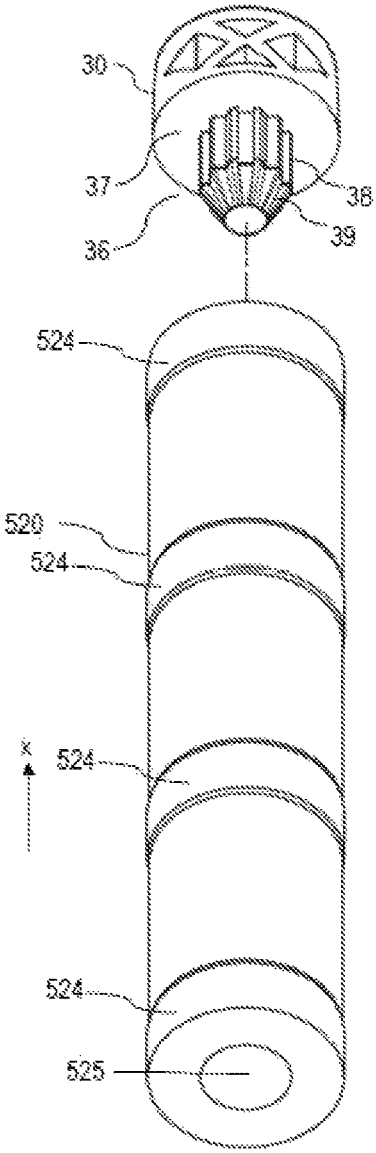
FIG. 43A is an exploded view of the dart, including a dart body with ridges formed thereon and dart cap, shown from a first perspective with the dart cap in the orientation of FIG. 41A in accordance with a sixth exemplary embodiment of the present invention.

Dart 510 includes an elongate dart body 520 that extends from a first end (a head end) 582 to a second end (a tail end) 584 of elongate dart body 520 in a first, longitudinal direction x (see FIG. 43A). Dart 510 further includes a dart cap 30 that is affixed to the head end of the dart body 520. In FIG. 41A, dart cap 30 is the same as dart cap 30 depicted and described above in connection with FIGS. 1A, 1B, 2A, 2B, 3A, 3B, and 4-8. Alternatively, in embodiments, dart body 520 may have any of dart cap 130, 230, 330, or 430 affixed to head end 582.

Elongate dart body 520 includes a lightweight material, such as a foam, that is suitable for use in a toy projectile and has an interior bore 325. Referring to FIGS. 41A and 43A, dart body 520 is illustrated as having, for example, an outer surface 523 that is substantially cylindrical in shape and interior bore 525 (or interior core) that is also cylindrical in shape with a circular cross-section. In embodiments, interior bore 525 may have a diameter that at its widest point is, for example, 5 mm, 5.5 mm, or 6 mm, to name a few. However, in embodiments, interior bore 525 may have a different diameter. Alternatively, elongate dart body 520 and/or interior bore 525 may have a different cross-sectional shape, such as an oval, pyramidal, diamond, heptagonal, or octagonal shape. Interior bore 525 may extend entirely or at least partially through dart body 520. In embodiments, interior bore 525 of dart body 520 may be lined with materials that provide dart body 520 with certain mechanical properties, e.g., rigidity or resiliency. In exemplary embodiments, the dart body 520 may be formed of one or more pieces.

In addition, as shown in FIG. 41A, dart body 520 has formed thereon a plurality of ridges 524. According to embodiments, each ridge 524 is formed on outer surface 523 and extends in a circle around the circumference of dart body 520. In FIG. 41A, dart body 520 is shown to have four ridges 524 formed on its outer surface 523. In embodiments, dart body 520 may have more or fewer ridges 524 formed on its outer surface 523. Further, instead of each ridge 524 extending in a circle around the circumference of dart body 520, in embodiments, some or all of ridges 524 may be elliptical in shape, where the ridge extends diagonally across and around dart body 520 so as to form a diagonal striping pattern of ridges on outer surface 523. In embodiments, ridges 524 may be formed of the same material as outer surface 523 of dart body 520, such as foam, or, alternatively, one or more of ridges 524 may be formed of a different material, such as rubber or plastic.

As noted above, dart cap 30 is affixed to the head end of dart body 520. The description of dart cap 30 depicted in FIG. 41A is the same as the description of dart cap 30 previously set forth and is not repeated here. The apertures of dart cap 30 shown in FIG. 41A are shown and described in connection with FIG. 1A. Furthermore, as noted, in embodiments, any of dart cap 130, 230, 330, and 440 as previously described may be affixed to the head end of dart body 520.

Figure 41B:
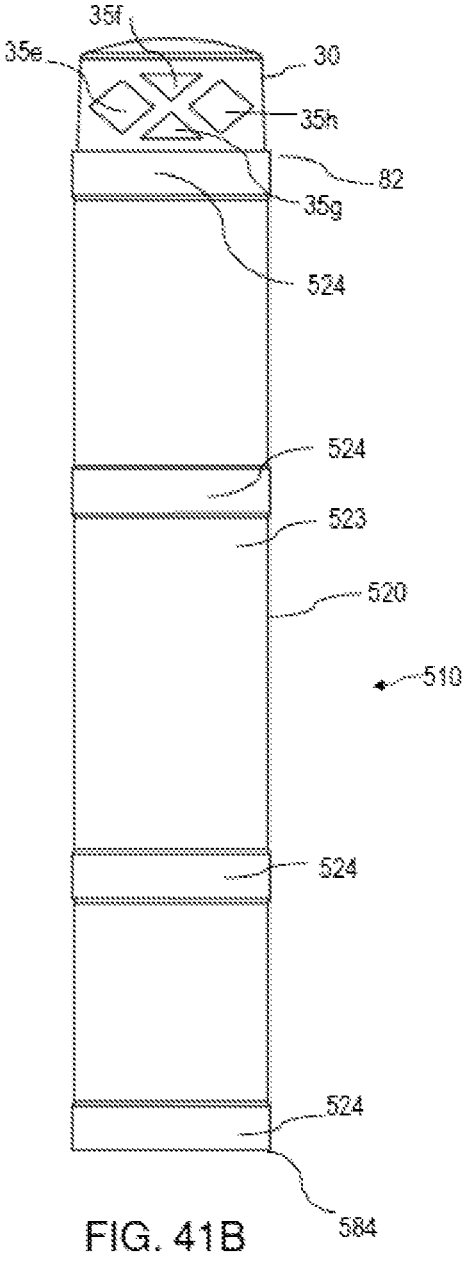
FIG. 41B is a plan view of the dart rotated 180 degrees from the angular orientation shown in FIG. 41A in accordance with a sixth exemplary embodiment of the present invention.

FIG. 41B is a plan view of dart 510 that is rotated by 180 degrees in the clockwise direction. As shown, each ridge 524 is formed at the same vertical height along the vertical axis of dart body 520 and extends in a circle around the circumference of dart body 520. Dart cap 30 is depicted in FIG. 41B, where the apertures of dart cap 30 in the figure are the same as those described in connection with FIG. 1B.

Figure 42A:
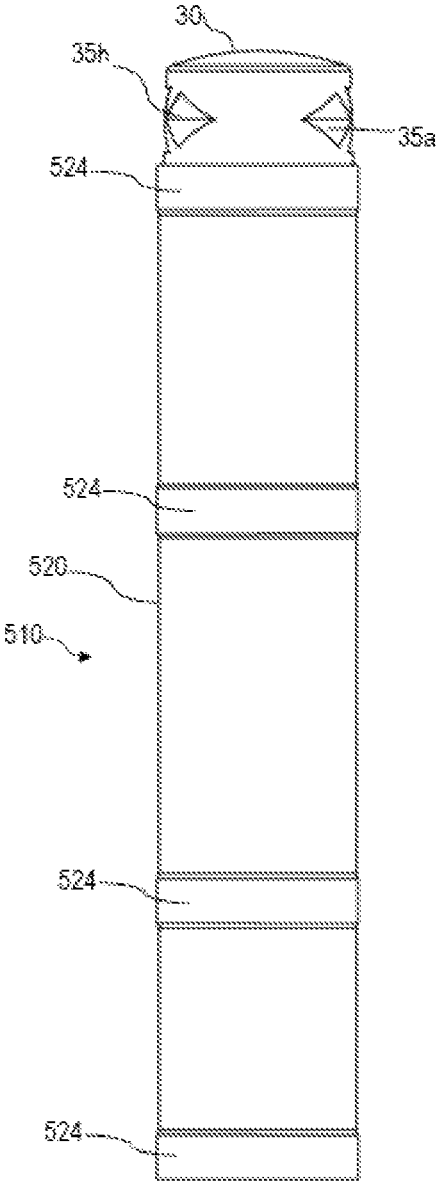
FIG. 42A is a plan view of the dart rotated 90 degrees clockwise from the angular orientation shown in FIG. 41A in accordance with a sixth exemplary embodiment of the present invention.
Figure 42B:
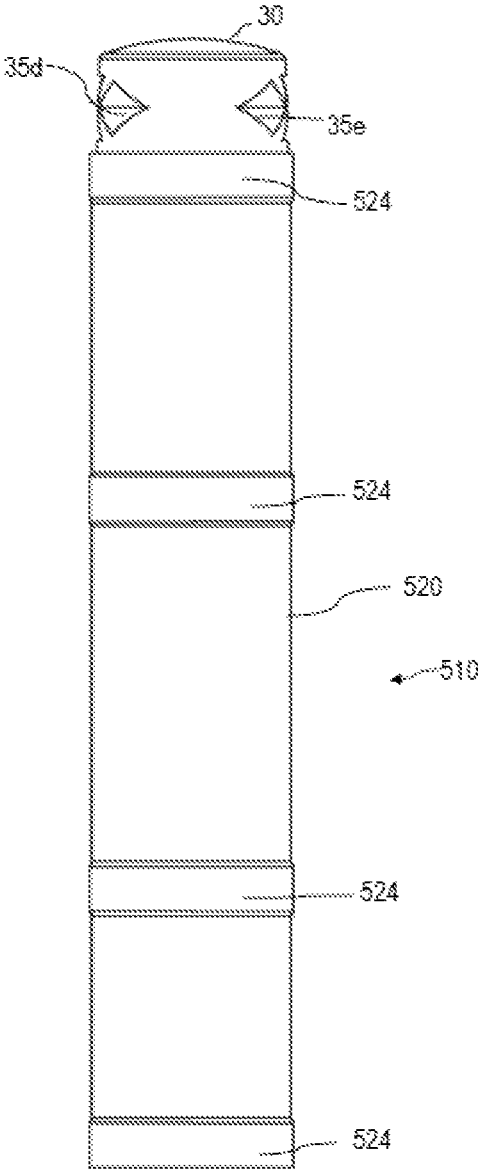
FIG. 42B is a plan view of the dart rotated 90 degrees counterclockwise from the angular orientation shown in FIG. 41A in accordance with a sixth exemplary embodiment of the present invention.

FIGS. 42A and 42B further illustrate the exemplary embodiment of the present invention, with FIG. 42A being a plan view of dart 510 rotated 90 degrees clockwise from the angular orientation shown in FIG. 41A and with FIG. 42B being a plan view of dart 510 rotated 90 degrees counterclockwise from the angular orientation shown in FIG. 41A. As shown, ridges 524 depicted in FIGS. 42A and 42B are each at the same vertical point along the vertical axis of dart body 520 as the ridges formed on the outer surface of dart body 520 that is depicted in the angular orientations shown in FIGS. 41A and 41B. Further, dart cap 30 and the apertures thereof depicted in FIGS. 42A and 42B are the same as those depicted and described in connection with FIGS. 2A and 2B, respectively.

Figure 43B:
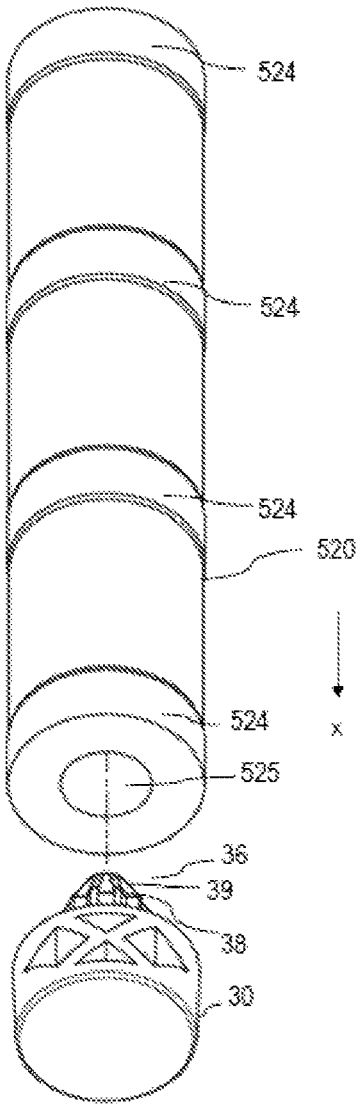
FIG. 43B is an exploded view of the dart, including a dart body with ridges formed thereon and dart cap, shown from a second perspective with the dart cap in the orientation of FIG. 41A in accordance with a sixth exemplary embodiment of the present invention.

The exploded views of FIGS. 43A and 43B show perspective views of dart body 520 and dart cap 30. The apertures of dart cap 30 depicted in FIGS. 43A and 43B are the same as those depicted and described in connection with FIGS. 3A and 3B.

As with dart body 20 shown in FIG. 3A, in embodiments, dart cap 30 in FIG. 43A may be affixed to dart body 520 with an adhesive, such as a glue, that may be applied around stem 36, inside the interior bore 525, and/or to a bottom surface 37 of dart cap 30. To provide additional surface area on dart cap 30 to more strongly affix cap 30 to dart body 520, stem 36 may include one or more grooves, such as grooves 38 and 39 that can accommodate additional adhesive. In embodiments, dart cap 30 may be affixed to dart body 520 in a manner other than with an adhesive.

Further, as described above, although stem 36 is illustrated with a particular design, it should be understood that the stem 36 for dart cap 30 is not limited to the illustrated design, and may be shaped and/or sized differently. For example, there may not be any grooves and stem 36 may have an enlarged plug attached to the bottom of stem 36 to help hold stem 36 within interior bore 525.

In addition, dart cap 30 is made to be heavier than the relatively lightweight configuration of dart body 520, such as by providing the various structures (e.g., exterior posts, interior walls, a thicker material top (e.g., dome shape)) and by choosing a particular composition of material, so as to position the center of gravity of dart 510 toward the head of the dart 510. This improves the accuracy and aerodynamics of dart 510.

While the above exemplary embodiments are described as having four and or three hollow passages formed by different polygonal apertures it is also possible, in other exemplary embodiments, to have additional hollow passages formed from additional polygonal apertures on the surface of the dart cap where the hollow passages are separated by one or more additional interior walls. The inclusion of additional structures would change the aerodynamics, the weight, and/or the rigidity of the dart cap. Where additional hollow passages are provided, in exemplary embodiments, the upper portion of the dart cap should have more hollow passages than the lower portion with the interior walls of the upper portion offset from the interior walls of the lower portion to allow the lower portion to deform more while maintaining a desired rigidity of the upper portion. Changes to the dart cap design may take into account the complexity of the mold that is required, the cost for additional materials, and any increased weight and/or rigidity of the toy dart, which may impact the aerodynamics and safety of the toy dart.

While particular embodiments of the present invention have been shown and described in detail, it would be obvious to those skilled in the art that various modifications and improvements thereon may be made without departing from the spirit and scope of the invention. It is therefore intended to cover in the appended claims all such modifications and improvements that are within the scope of this invention.

What is claimed is:

1. A toy dart comprising:

an elongate dart body having a head end and a tail end, the dart body extending in a longitudinal direction; and a solid cylindrical deformable dart cap, wherein the cylindrical deformable dart cap has an outer wall having a top edge and a bottom edge, the outer wall forming a circumference of the cylindrical deformable dart cap, a top surface adjoining the top edge of the outer wall, and a bottom surface adjoining the bottom edge of the outer wall, wherein the bottom surface is affixed to and abuts the head end of the elongate dart body, wherein the outer wall has formed thereon a plurality of polygonal aperture pairs, each polygonal aperture pair comprising a pair of apertures that are substantially the same size, shape, and orientation, wherein each polygonal aperture pair defines a first and second end of a corresponding hollow passage through the cylindrical deformable dart cap, and wherein each of the hollow passages has a plurality of interior walls that forms a cross section of the hollow passage, each cross section having substantially the same size, shape and orientation as the polygonal aperture pair corresponding to the respective hollow passage, wherein the plurality of polygonal aperture pairs comprises a first aperture pair that defines a first and second end of a first hollow passage, a second aperture pair that defines a first and second end of a second hollow passage, a third aperture pair that defines a first and second end of a third hollow passage, and a fourth aperture pair that defines a first and second end of a fourth hollow passage, wherein the respective first ends of the second and third hollow passages are located along a first minor arc of the circumference of the cylindrical deformable dart cap that extends between the respective first ends of the first and fourth hollow passages, and wherein the respective second ends of the second and third hollow passages are located along a second minor arc of the circumference of the cylindrical deformable dart cap that extends between the respective second ends of the first and fourth hollow passages.

2. The toy dart of claim 1, wherein the top surface is substantially flat.

3. The toy dart of claim 1, wherein the top surface is substantially curved.

4. The toy dart of claim 3, wherein the top surface of the cylindrical deformable dart cap is shaped as a spherical segment, spherical frustum, or spherical dome.

5. The toy dart of claim 1, wherein the first, second, third, and fourth hollow passages are substantially parallel, wherein the first end of the second passage is at a location above the first end of the third passage in the longitudinal direction, and wherein the second end of the second passage is at a location above the second end of the third passage in the longitudinal direction.

6. The toy dart of claim 5, wherein the cross sections of the first and fourth hollow passages are substantially diamond-shaped, and wherein the cross sections of the second and third hollow passages are substantially triangle-shaped.

7. The toy dart of claim 6, wherein the second hollow passage is oriented such that the apex of the triangle shaped second hollow passage is pointed toward the bottom surface of the cylindrical deformable dart cap and the third hollow passage is oriented such that the apex of the triangle-shaped third hollow passage is pointed toward the top surface of the cylindrical deformable dart cap.

8. The toy dart of claim 5, wherein the cross sections of the first, second, third and fourth hollow passages are substantially triangle-shaped.

9. The toy dart of claim 8, wherein the first hollow passage is oriented such that the apex of the triangle-shaped first hollow passage is pointed in a clockwise direction around the circumference of the cylindrical deformable dart cap, wherein the second hollow passage is oriented such that the apex of the triangle-shaped second hollow passage is pointed toward the bottom surface of the cylindrical deformable dart cap, wherein the third hollow passage is oriented such that the apex of the triangle-shaped third hollow passage is pointed toward the top surface of the cylindrical deformable dart cap, and wherein the fourth hollow passage is oriented such that the apex of the triangle-shaped fourth hollow passage is pointed in a counterclockwise direction around the circumference of the cylindrical deformable dart cap.

10. The toy dart of claim 9, wherein the first and third hollow passages are approximately equal in cross sectional area.

11. The toy dart of claim 1, wherein the cylindrical deformable dart cap comprises a material with a Shore A durometer that is within a range of 20 to 40.

12. The toy dart of claim 1, wherein the cylindrical deformable dart cap comprises a material with a Shore A durometer of approximately 30.

13. The toy dart of claim 1, wherein the cylindrical deformable dart cap has a Shore A durometer that is within a range of 20 to 80.

14. The toy dart of claim 1, wherein the cylindrical deformable dart cap has a Shore A durometer that is within a range of 40 to 70.

15. The toy dart of claim 1, wherein the cylindrical deformable dart cap has a Shore A durometer of approximately 70.

16. The toy dart of claim 1, wherein the elongate dart body is cylindrical.

17. The toy dart of claim 1, wherein the top surface of the cylindrical deformable dart cap has a diameter of approximately 12.5 mm.

18. The toy dart of claim 1, wherein the cylindrical deformable dart cap comprises thermoplastic rubber (TPR) that is injection molded.

19. The toy dart of claim 1, wherein the cylindrical deformable dart cap has a unitary structure.

20. The toy dart of claim 1, wherein the first and fourth hollow passages are approximately equal in shape and cross sectional area.

21. The toy dart of claim 20, wherein the second and third hollow passages are approximately equal in cross sectional area and wherein the second and third hollow passages each has a smaller cross sectional area than each of the first and fourth hollow passages.

22. The toy dart of claim 1, wherein the dart body has an outer surface that is smooth.

23. The toy dart of claim 1, wherein the dart body has an outer surface that has ridges formed thereon.

24. A toy dart comprising:

an elongate dart body having a head end and a tail end, the dart body extending in a longitudinal direction; and a solid cylindrical deformable dart cap, wherein the cylindrical deformable dart cap has an outer wall having a top edge and a bottom edge, the outer wall forming a circumference of the cylindrical deformable dart cap, a top surface adjoining the top edge of the outer wall, and a bottom surface adjoining the bottom edge of the outer wall, wherein the bottom surface is affixed to and abuts the head end of the elongate dart body, wherein the outer wall has formed thereon a plurality of polygonal aperture pairs, each polygonal aperture pair comprising a pair of apertures that are substantially the same size, shape, and orientation, wherein each polygonal aperture pair defines a first and second end of a corresponding hollow passage through the cylindrical deformable dart cap, wherein each of the hollow passages has a plurality of interior walls that forms a cross section of the hollow passage, each cross section having substantially the same size, shape and orientation as the polygonal aperture pair corresponding to the respective hollow passage, wherein the plurality of polygonal aperture pairs comprises a first aperture pair that defines a first and second end of a first hollow passage, a second aperture pair that defines a first and second end of a second hollow passage, a third aperture pair that defines a first and second end of a third hollow passage, and a fourth aperture pair that defines a first and second end of a fourth hollow passage, wherein the respective first ends of the second and third hollow passages are located along a first minor arc of the circumference of the cylindrical deformable dart cap that extends between the respective first ends of the first and fourth hollow passages, wherein the respective second ends of the second and third hollow passages are located along a second minor arc of the circumference of the cylindrical deformable dart cap that extends between the respective second ends of the first and fourth hollow passages, wherein the cross sections of the first and fourth hollow passages are substantially diamond-shaped, wherein the cross sections of the second and third hollow passages are substantially triangle-shaped, and wherein the second hollow passage is oriented such that the apex of the triangle shaped second hollow passage is pointed toward the bottom surface of the cylindrical deformable dart cap and the third hollow passage is oriented such that the apex of the triangle-shaped third hollow passage is pointed toward the top surface of the cylindrical deformable dart cap.

25. A toy dart comprising:

an elongate dart body having a head end and a tail end, the dart body extending in a longitudinal direction; and a solid cylindrical deformable dart cap, wherein the cylindrical deformable dart cap has an outer wall having a top edge and a bottom edge, the outer wall forming a circumference of the cylindrical deformable dart cap, a top surface adjoining the top edge of the outer wall, and a bottom surface adjoining the bottom edge of the outer wall, wherein the bottom surface is affixed to and abuts the head end of the elongate dart body, wherein the outer wall has formed thereon a plurality of polygonal aperture pairs, each polygonal aperture pair comprising a pair of apertures that are substantially the same size, shape, and orientation, wherein each polygonal aperture pair defines a first and second end of a corresponding hollow passage through the cylindrical deformable dart cap, wherein each of the hollow passages has a plurality of interior walls that forms a cross section of the hollow passage, each cross section having substantially the same size, shape and orientation as the polygonal aperture pair corresponding to the respective hollow passage, wherein the plurality of polygonal aperture pairs comprises a first aperture pair that defines a first and second end of a first hollow passage, a second aperture pair that defines a first and second end of a second hollow passage, a third aperture pair that defines a first and second end of a third hollow passage, and a fourth aperture pair that defines a first and second end of a fourth hollow passage, wherein the respective first ends of the second and third hollow passages are located along a first minor arc of the circumference of the cylindrical deformable dart cap that extends between the respective first ends of the first and fourth hollow passages, wherein the respective second ends of the second and third hollow passages are located along a second minor arc of the circumference of the cylindrical deformable dart cap that extends between the respective second ends of the first and fourth hollow passages, wherein the cross sections of the first, second, third and fourth hollow passages are substantially triangle-shaped, wherein the first hollow passage is oriented such that the apex of the triangle-shaped first hollow passage is pointed in a clockwise direction around the circumference of the cylindrical deformable dart cap, wherein the second hollow passage is oriented such that the apex of the triangle-shaped second hollow passage is pointed toward the bottom surface of the cylindrical deformable dart cap, wherein the third hollow passage is oriented such that the apex of the triangle-shaped third hollow passage is pointed toward the top surface of the cylindrical deformable dart cap, and wherein the fourth hollow passage is oriented such that the apex of the triangle-shaped fourth hollow passage in a counterclockwise direction around the circumference of the cylindrical deformable dart cap.

26. A toy dart comprising:

an elongate dart body having a head end and a tail end, the dart body extending in a longitudinal direction; and a solid cylindrical deformable dart cap, wherein the cylindrical deformable dart cap has an outer wall having a top edge and a bottom edge, the outer wall forming a circumference of the cylindrical deformable dart cap, a top surface adjoining the top edge of the outer wall, and a bottom surface adjoining the bottom edge of the outer wall, wherein the bottom surface is affixed to and abuts the head end of the elongate dart body, wherein the outer wall has formed thereon a plurality of polygonal aperture pairs, each polygonal aperture pair comprising a pair of apertures that are substantially the same size, shape, and orientation, wherein each polygonal aperture pair defines a first and second end of a corresponding hollow passage through the cylindrical deformable dart cap, wherein each of the hollow passages has a plurality of interior walls that forms a cross section of the hollow passage, each cross section having substantially the same size, shape and orientation as the polygonal aperture pair corresponding to the respective hollow passage, wherein the plurality of polygonal aperture pairs comprises a first aperture pair that defines a first and second end of a first hollow passage, a second aperture pair that defines a first and second end of a second hollow passage, and a third aperture pair that defines a first and second end of a third hollow passage, wherein the first end of the second hollow passage is located along a minor arc of the circumference of the solid cylindrical deformable dart cap that extends between the respective first ends of the first and third hollow passages, wherein the second end of the second hollow passage is located along a minor arc of the circumference of the solid cylindrical deformable dart cap that extends between the respective second ends of the first and third hollow passages, wherein the cross sections of the first, second, and third hollow passages are substantially triangle-shaped, wherein the first hollow passage is oriented such that the apex of the triangle-shaped first hollow passage is pointed toward the top surface of the cylindrical deformable dart cap, wherein the second hollow passage is oriented such that the apex of the triangle-shaped second hollow passage is pointed toward the bottom surface of the cylindrical deformable dart cap, and wherein the third hollow passage is oriented such that the apex of the triangle-shaped third hollow passage is pointed toward the top surface of the cylindrical deformable dart cap.

27. A toy dart comprising:

an elongate dart body having a head end and a tail end, the dart body extending in a longitudinal direction; and a solid cylindrical deformable dart cap, wherein the cylindrical deformable dart cap has an outer wall having a top edge and a bottom edge, the outer wall forming a circumference of the cylindrical deformable dart cap, a top surface adjoining the top edge of the outer wall, and a bottom surface adjoining the bottom edge of the outer wall, wherein the bottom surface is affixed to and abuts the head end of the elongate dart body, wherein the outer wall has formed thereon a plurality of polygonal aperture pairs, each polygonal aperture pair comprising a pair of apertures that are substantially the same size, shape, and orientation, wherein each polygonal aperture pair defines a first and second end of a corresponding hollow passage through the cylindrical deformable dart cap, wherein each of the hollow passages has a plurality of interior walls that forms a cross section of the hollow passage, each cross section having substantially the same size, shape and orientation as the polygonal aperture pair corresponding to the respective hollow passage, wherein the plurality of polygonal aperture pairs comprises a first aperture pair that defines a first and second end of a first hollow passage, a second aperture pair that defines a first and second end of a second hollow passage, and a third aperture pair that defines a first and second end of a third hollow passage, wherein the first end of the second hollow passage is located along a minor arc of the circumference of the solid cylindrical deformable dart cap that extends between the respective first ends of the first and third hollow passages, wherein the second end of the second hollow passage is located along a minor arc of the circumference of the solid cylindrical deformable dart cap that extends between the respective second ends of the first and third hollow passages, wherein the cross sections of the first, second, and third hollow passages are substantially triangle-shaped, wherein the first hollow passage is oriented such that the apex of the triangle-shaped first hollow passage is pointed toward the bottom surface of the cylindrical deformable dart cap, wherein the second hollow passage is oriented such that the apex of the triangle-shaped second hollow passage is pointed toward the top surface of the cylindrical deformable dart cap, and wherein the third hollow passage is oriented such that the apex of the triangle-shaped third hollow passage is pointed toward the bottom surface of the cylindrical deformable dart cap.

28. A toy dart comprising:

an elongate dart body having a head end and a tail end, the dart body extending in a longitudinal direction; and a solid cylindrical deformable dart cap, wherein the cylindrical deformable dart cap has an outer wall having a top edge and a bottom edge, the outer wall forming a circumference of the cylindrical deformable dart cap, a top surface adjoining the top edge of the outer wall, and a bottom surface adjoining the bottom edge of the outer wall, wherein the bottom surface is affixed to and abuts the head end of the elongate dart body, wherein the outer wall has formed thereon a plurality of polygonal aperture pairs, each polygonal aperture pair comprising a pair of apertures that are substantially the same size, shape, and orientation, wherein each polygonal aperture pair defines a first and second end of a corresponding hollow passage through the cylindrical deformable dart cap, wherein each of the hollow passages has a plurality of interior walls that forms a cross section of the hollow passage, each cross section having substantially the same size, shape and orientation as the polygonal aperture pair corresponding to the respective hollow passage, wherein the plurality of polygonal aperture pairs comprises a first aperture pair that defines a first and second end of a first hollow passage, a second aperture pair that defines a first and second end of a second hollow passage, and a third aperture pair that defines a first and second end of a third hollow passage, wherein the first end of the second hollow passage is located along a minor arc of the circumference of the solid cylindrical deformable dart cap that extends between the respective first ends of the first and third hollow passages, wherein the second end of the second hollow passage is located along a minor arc of the circumference of the solid cylindrical deformable dart cap that extends between the respective second ends of the first and third hollow passages, wherein the cross sections of the first, second, and third hollow passages are substantially triangle-shaped, wherein the aperture corresponding to the first end of the first hollow passage is formed as a first right triangle oriented such that the hypotenuse of the first right triangle faces the aperture corresponding to the first end of the second hollow passage, wherein the aperture corresponding to the first end of the second hollow passage is formed as a second triangle oriented such that the apex of the second triangle is pointed toward the bottom surface of the cylindrical deformable dart cap, wherein the aperture corresponding to the first end of the third hollow passage is formed as a third right triangle oriented such that the hypotenuse of the third right third triangle faces the aperture corresponding to the first end of the second hollow passage, wherein the aperture corresponding to the second end of the first hollow passage is formed as a fourth right triangle oriented such that the hypotenuse of the fourth right triangle faces the aperture corresponding to the second end of the second hollow passage, wherein the aperture corresponding to the second end of the second hollow passage is formed as a fifth triangle oriented such that the apex of the fifth triangle is pointed toward the bottom surface of the cylindrical deformable dart cap, wherein the aperture corresponding to the second end of the third hollow passage is formed as a sixth right triangle oriented such that the hypotenuse of the sixth right third triangle faces the aperture corresponding to the second end of the second hollow passage, wherein the first hollow passage has an outer surface that is a vertical post, and wherein the third hollow passage has an outer surface that is a vertical post.

29. A toy dart comprising:

an elongate dart body having a head end and a tail end, the dart body extending in a longitudinal direction; and a solid cylindrical deformable dart cap, wherein the cylindrical deformable dart cap has an outer wall having a top edge and a bottom edge, the outer wall forming a circumference of the cylindrical deformable dart cap, a top surface adjoining the top edge of the outer wall, and a bottom surface adjoining the bottom edge of the outer wall, wherein the bottom surface is affixed to and abuts the head end of the elongate dart body, wherein the outer wall has formed thereon a plurality of polygonal aperture pairs, each polygonal aperture pair comprising a pair of apertures that are substantially the same size, shape, and orientation, wherein each polygonal aperture pair defines a first and second end of a corresponding hollow passage through the cylindrical deformable dart cap, and wherein each of the hollow passages has a plurality of interior walls that forms a cross section of the hollow passage, each cross section having substantially the same size, shape and orientation as the polygonal aperture pair corresponding to the respective hollow passage, wherein the plurality of polygonal aperture pairs comprises a first aperture pair that defines a first and second end of a first hollow passage, a second aperture pair that defines a first and second end of a second hollow passage, and a third aperture pair that defines a first and second end of a third hollow passage, wherein the first end of the second hollow passage is located along a minor arc of the circumference of the solid cylindrical deformable dart cap that extends between the respective first ends of the first and third hollow passages, and wherein the second end of the second hollow passage is located along a minor arc of the circumference of the solid cylindrical deformable dart cap that extends between the respective second ends of the first and third hollow passages, wherein the first, second, and third hollow passages are substantially parallel, and wherein the cross sections of the first, second, and third hollow passages are substantially triangle-shaped.

30. The toy dart of claim 29, wherein the first hollow passage is oriented such that the apex of the triangle-shaped first hollow passage is pointed toward the top surface of the cylindrical deformable dart cap, wherein the second hollow passage is oriented such that the apex of the triangle-shaped second hollow passage is pointed toward the bottom surface of the cylindrical deformable dart cap, wherein the third hollow passage is oriented such that the apex of the triangle-shaped third hollow passage is pointed toward the top surface of the cylindrical deformable dart cap.

31. The toy dart of claim 29, wherein the cylindrical deformable dart cap is shaped as a truncated cone.

* * * * *